US008353416B2

(12) United States Patent
Mueller

(10) Patent No.: US 8,353,416 B2
(45) Date of Patent: Jan. 15, 2013

(54) BOTTOM-DUMPING FLEXIBLE DEBRIS CONTAINER

(75) Inventor: Mark S. Mueller, Bothell, WA (US)

(73) Assignee: MCF Distributing LLC, Mill Creek, WA (US)

( * ) Notice: Subject to any disclaimer, the term of this patent is extended or adjusted under 35 U.S.C. 154(b) by 827 days.

(21) Appl. No.: 12/386,929

(22) Filed: Apr. 24, 2009

(65) Prior Publication Data

US 2010/0272378 A1 Oct. 28, 2010

(51) Int. Cl.
*B65D 6/00* (2006.01)
*B65D 25/22* (2006.01)
*B65D 45/16* (2006.01)

(52) U.S. Cl. ..... 220/4.33; 220/324; 220/475

(58) Field of Classification Search ..... 220/4.33, 220/1.6, 9.4, 475, 315, 324, 328, 819, 822, 220/833, 843, 836; 383/67, 68, 78, 123, 383/124, 117, 119, 120, 13, 17, 18, 22, 24; 414/185, 378, 379; 222/181.1, 185.1; 248/146
See application file for complete search history.

(56) References Cited

U.S. PATENT DOCUMENTS

| | | | | | |
|---|---|---|---|---|---|
| 1,971,395 | A * | 8/1934 | Danner | 383/99 |
| 3,141,609 | A | 7/1964 | Roth | |
| 3,464,733 | A * | 9/1969 | Shaw | 294/68.21 |
| 3,827,471 | A * | 8/1974 | Gregory et al. | 222/181.3 |
| 3,893,595 | A * | 7/1975 | Khanna et al. | 222/181.3 |
| 3,921,892 | A | 11/1975 | Macie | |
| 4,119,263 | A | 10/1978 | Cuthbertson et al. | |
| 4,142,754 | A | 3/1979 | Colvin | |
| 4,286,818 | A | 9/1981 | Flammini | |
| 4,705,446 | A | 11/1987 | Miller | |
| 4,768,670 | A | 9/1988 | Lin et al. | |
| 4,917,507 | A * | 4/1990 | Davidson | 383/67 |
| 5,022,546 | A | 6/1991 | Bock et al. | |
| 5,975,759 | A * | 11/1999 | Renaud | 383/22 |
| 6,431,753 | B1 * | 8/2002 | Rogers et al. | 383/41 |
| 6,467,955 | B1 * | 10/2002 | Kim | 383/20 |
| 2003/0235350 | A1 * | 12/2003 | Richardson et al. | 383/24 |
| 2005/0056640 | A1 | 3/2005 | Acosta | |
| 2005/0232736 | A1 | 10/2005 | Fellows et al. | |
| 2007/0108085 | A1 | 5/2007 | Andrade | |
| 2008/0135566 | A1 | 6/2008 | Johnson | |

OTHER PUBLICATIONS

ECO-PAN—Providing the Best Solutions for Containment, Disposal, and Recycling of Cementitious Construction Waste and Debris, http://eco-pan.com, printed Dec. 10, 2008.
Northwest Construction Debris Management Incorporated Brochure, 2008.
Explanatory Addendum to Northwest Construction Debris Management Incorporated Brochure.

* cited by examiner

*Primary Examiner* — Bryon Gehman
*Assistant Examiner* — Shawn Braden
(74) *Attorney, Agent, or Firm* — Bryan A. Santarelli; Graybeal Jackson LLP

(57) ABSTRACT

In a non-limiting, illustrative embodiment a bottom-dumping flexible debris container includes a top section including flexible side members. A bottom section includes flexible bottom members that are hingedly attached to the flexible side members of the top section. A release mechanism is configured to releasably attach the flexible bottom members to each other.

39 Claims, 37 Drawing Sheets

BOTTOM-DUMPING FLEXIBLE DEBRIS CONTAINER

BACKGROUND

Construction debris is generated during construction of a building or other facility. The debris is collected and transported from the construction site for disposal.

Currently, debris is typically brought to a single fixed point for collection in a large, pre-assembled construction debris container, such as a steel dumpster, that is located at a fixed location on the ground at a construction site. The debris may be hand-carried or brought in a wheel barrow or the like to the construction debris container in multiple trips of small loads of debris. At multiple story construction sites, a trash chute may be constructed at a single fixed point above the construction debris container. Nonetheless, the debris is still hand-carried or brought in a wheel barrow or the like to the trash chute in multiple trips of small loads of debris.

The foregoing examples of related art and limitations associated therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems and methods which are meant to be illustrative, not limiting in scope. In various embodiments, one or more of the problems described above in the Background have been reduced or eliminated, while other embodiments are directed to other improvements.

In a non-limiting, illustrative embodiment a bottom-dumping flexible debris container is provided. A top section includes flexible side members. A bottom section includes flexible bottom members that are hingedly attached to the flexible side members of the top section. A release mechanism is configured to releasably attach the flexible bottom members to each other.

In another non-limiting, illustrative embodiment a method of using a bottom-dumping flexible container is provided. Flexible bottom members of a bottom section of a bottom-dumping flexible container are releasably attached to each other toward a central region of the bottom section. A top section of the bottom-dumping flexible container is supported, the top section having flexible side members, the top section being hingedly attached to the flexible bottom members.

In another non-limiting, illustrative embodiment a method of manufacturing a bottom-dumping flexible container is provided. Flexible side members are formed into a top section. Flexible bottom members are formed into a bottom section. A release mechanism configured to releasably attach the flexible bottom members to each other is attached to one of the flexible bottom members. The flexible bottom members are hingedly attached to the flexible side members of the top section.

In addition to the illustrative embodiments and aspects described above, further embodiments and aspects will become apparent by reference to the drawings and by study of the following detailed description.

BRIEF DESCRIPTION OF THE DRAWINGS

Illustrative embodiments are illustrated in referenced figures of the drawings. It is intended that the embodiments and figures disclosed herein are to be considered illustrative rather than restrictive.

DETAILED DESCRIPTION

Figure 1A:
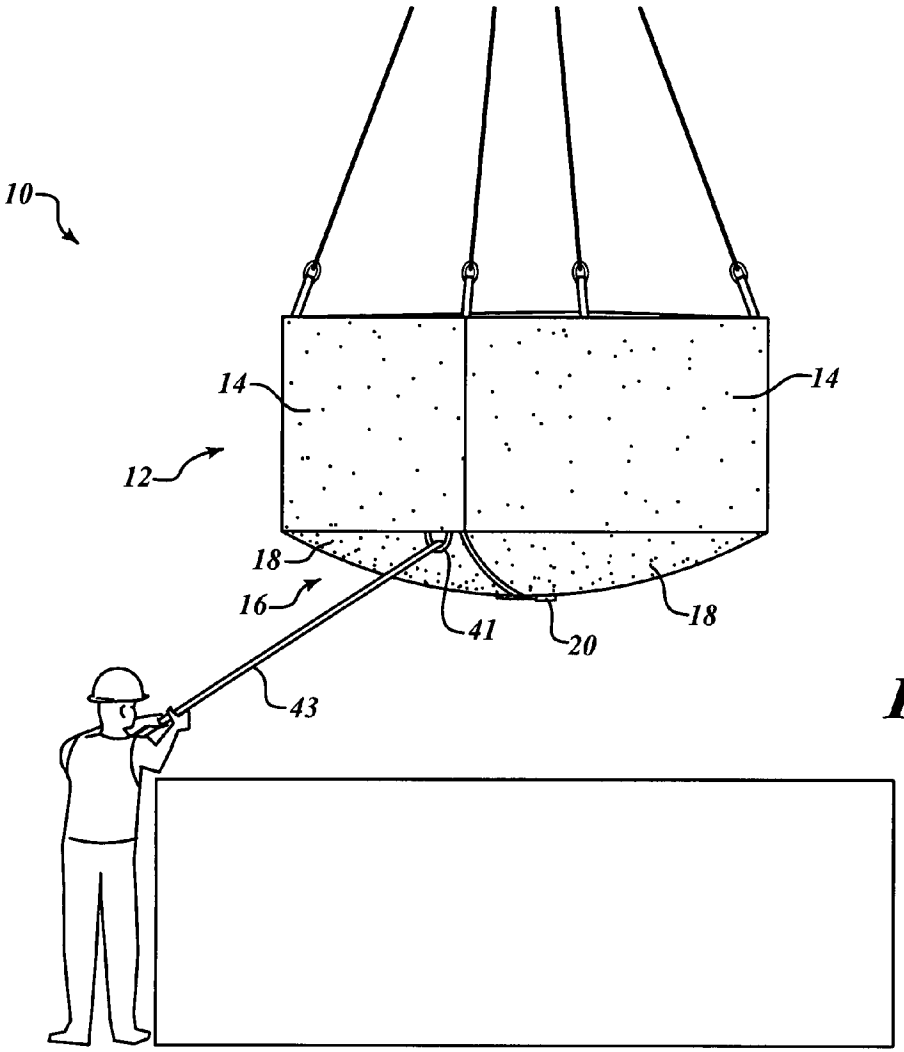
FIGS. 1A-1C are perspective views of an illustrative bottom-dumping flexible debris container in various stages of operation.

By way of overview and referring to FIG. 1A, in some non-limiting, illustrative embodiments, a bottom-dumping flexible debris container 10 is provided. A top section 12 includes flexible side members 14. A bottom section 16 includes flexible bottom members 18 that are hingedly attached to the flexible side members 14 of the top section 12. A release mechanism 20 is configured to releasably attach the flexible bottom members 18 to each other. Still by way of overview, and referring now to FIGS. 1B and 1C, the flexible bottom members 18 are released from releasable attachment to each other such that content 22 of the bottom-dumping flexible container 10 is gravitationally urged from the bottom-dumping flexible container 12. Illustrative details of non-limiting examples will be discussed below.

Figure 2A:
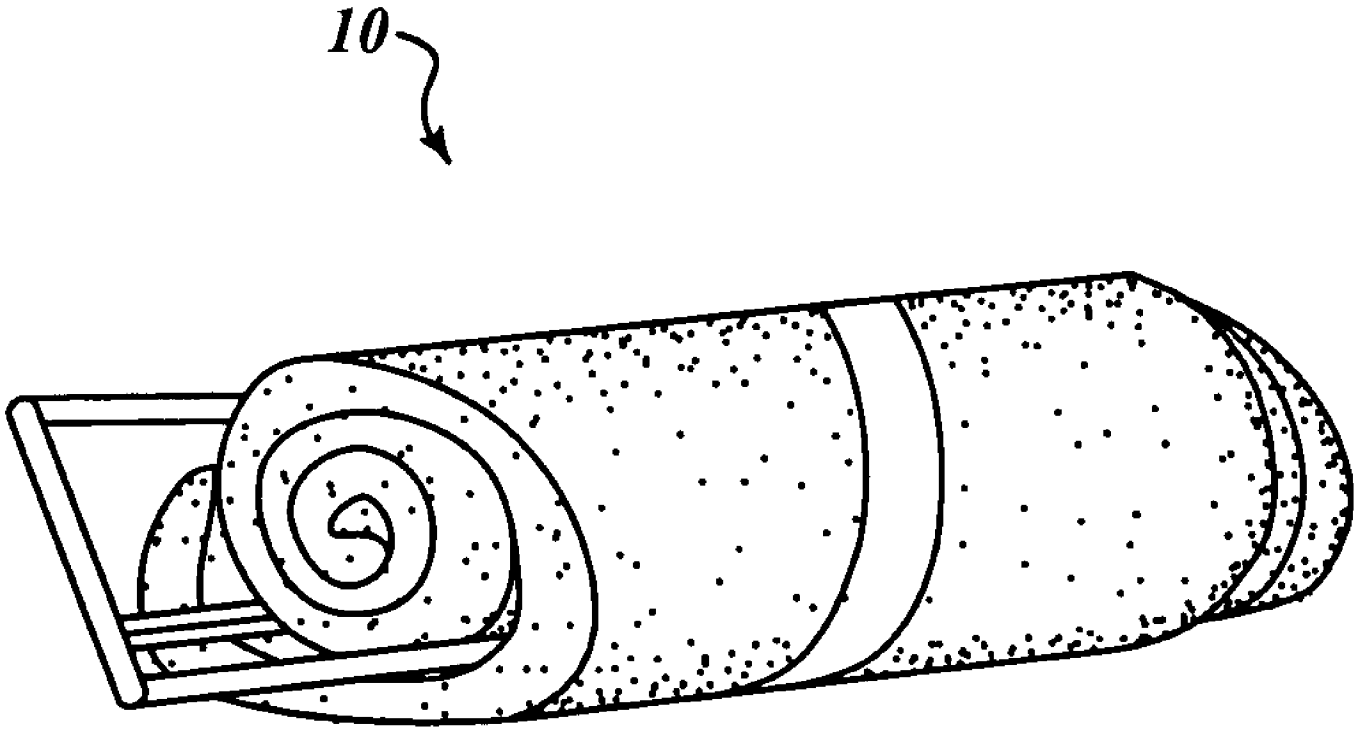
FIGS. 2A-2F illustrate non-limiting embodiments of bottom-dumping flexible debris containers and support devices.

The bottom-dumping flexible debris container 10 may be made of components that are lightweight and flexible yet provide sufficient, strength and durability to contain construction debris. For example, the flexible side members 14 and the flexible bottom members 18 may be made from flexible materials as desired for a particular application. For example, in some embodiments mesh materials, such as vinyl coated polyester mesh material, may be used. However, it will be appreciated that any flexible material, such as without limitation fabric, polyester, plastic, or the like, may be used as desired for a particular application. As a result and referring now to FIG. 2A, the bottom-dumping flexible debris container 10 may be collapsible. In some embodiments, the bottom-dumping flexible debris container 10 may be rolled up as desired, such as for storage and transport to and from a work site.

Figure 2B:
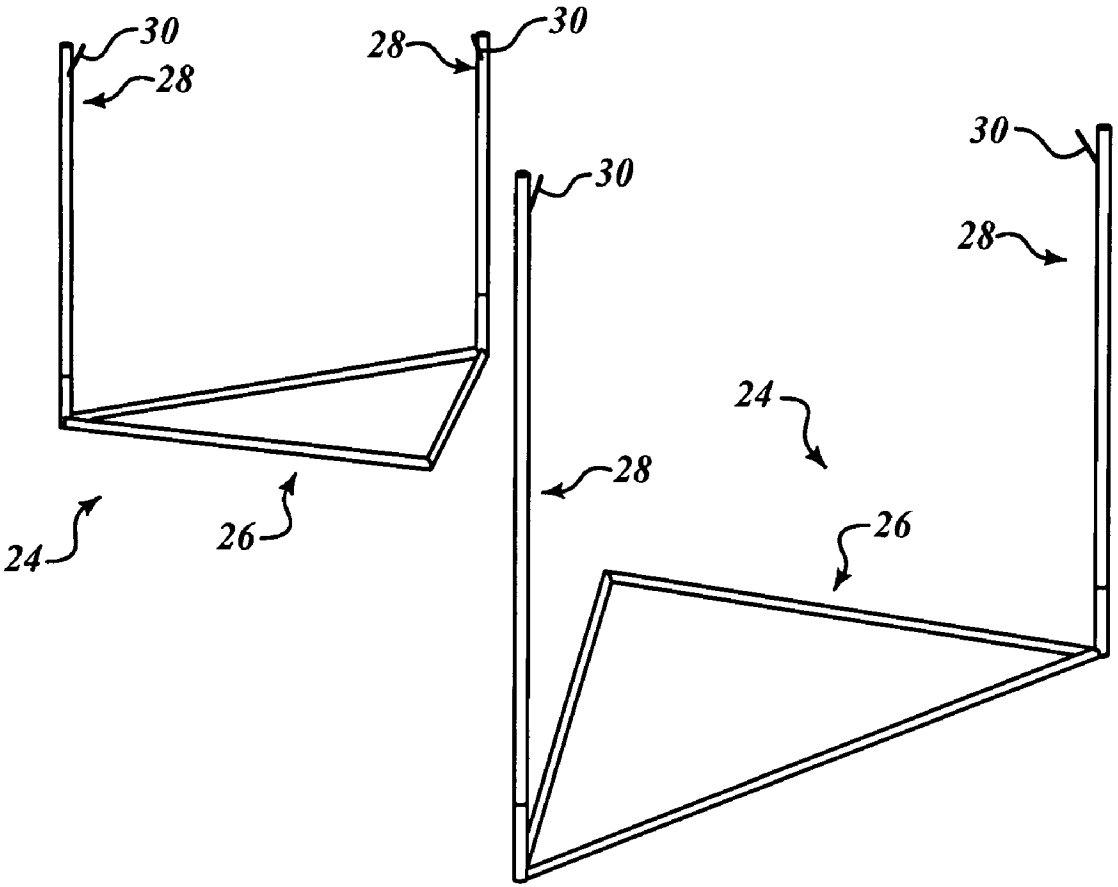

Once the bottom-dumping flexible debris container 10 is brought to a work site it may be set up for use as desired. In some embodiments, the bottom-dumping flexible debris container 10 may be set up on a substantially horizontal surface, such as the ground at a work site or on a floor. In such an application and referring now to FIG. 2B, one or more stands 24 may be set up on a surface. The stand 24 may include a horizontal base 26 and vertical support members 28 that are attached to the horizontal base 26. In some embodiments, the vertical support members 28 may be removably attached to the horizontal base 26. An attachment member 30 is attached to the vertical support member 28.

Figure 2C:
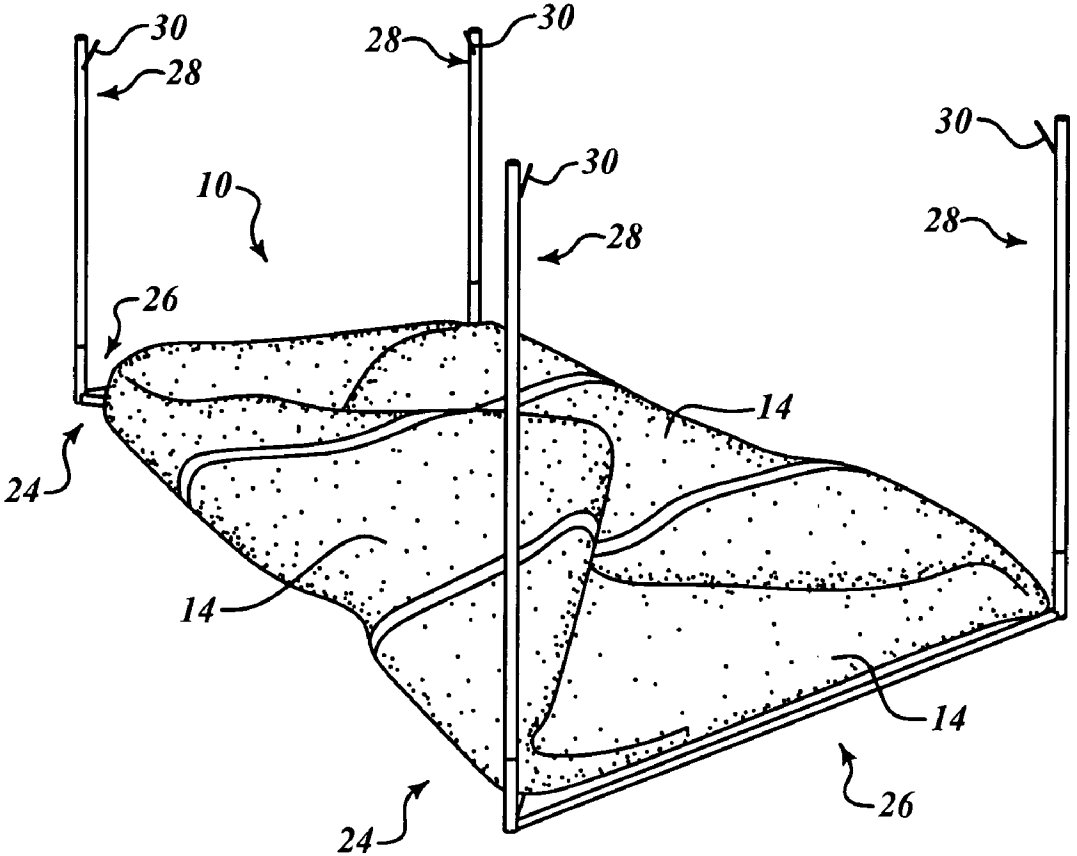

Referring now to FIG. 2C, the bottom-dumping flexible debris container 10 may be spread out inside the stands 24 in preparation for supporting the bottom-dumping flexible debris container 10 from the stands 24. Exterior surfaces of the flexible bottom members 18 (not shown in FIG. 2C) are received on the substantially horizontal surface (such as the ground or a floor) and the flexible side members 14 are arranged on top of the flexible bottom members 18.

Figure 2D:
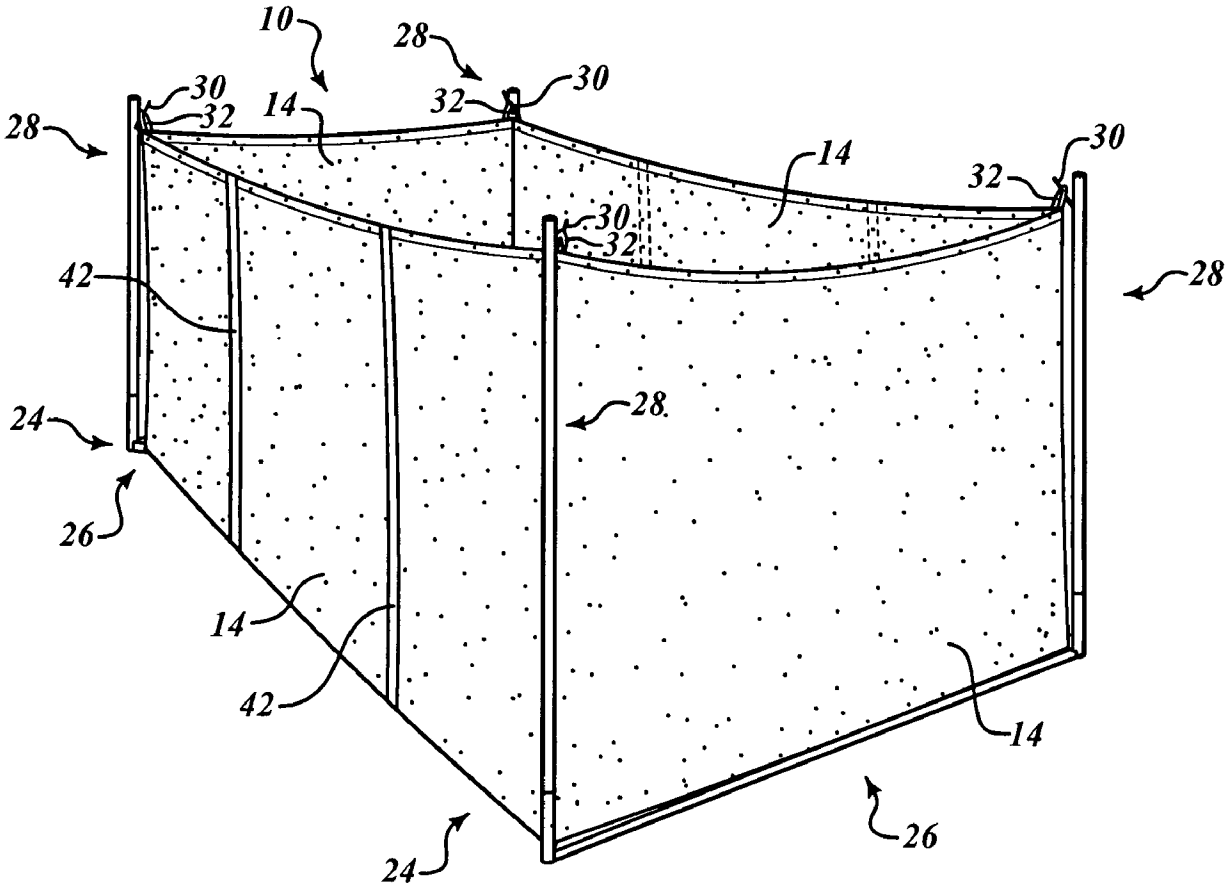

Referring now to FIG. 2D, the top section 12 of the bottom-dumping flexible container 10 is supported by being removably attached to the stands 24. The top section 12 includes hooks 32 that are configured to receive therein the attachment members 30 (shown in phantom). The hooks 32 suitably are made from nylon webbing or the like. The hooks 32 are attached to an upper region, and may be attached to an upper edge if desired, of the flexible side members 14 by a suitable attachment method as desired for a particular application. For example, in some embodiments the hooks 32 may be attached by sewing. In some other embodiments, the hooks 32 may be attached by welding, such as radiofrequency (RF) welding or hot air welding. The flexible side members 14 are raised and the hooks 32 are placed over the attachment members 30 (shown in phantom), thereby supporting the top section 12 of the bottom-dumping flexible container 10.

Figures 2E, 2F:
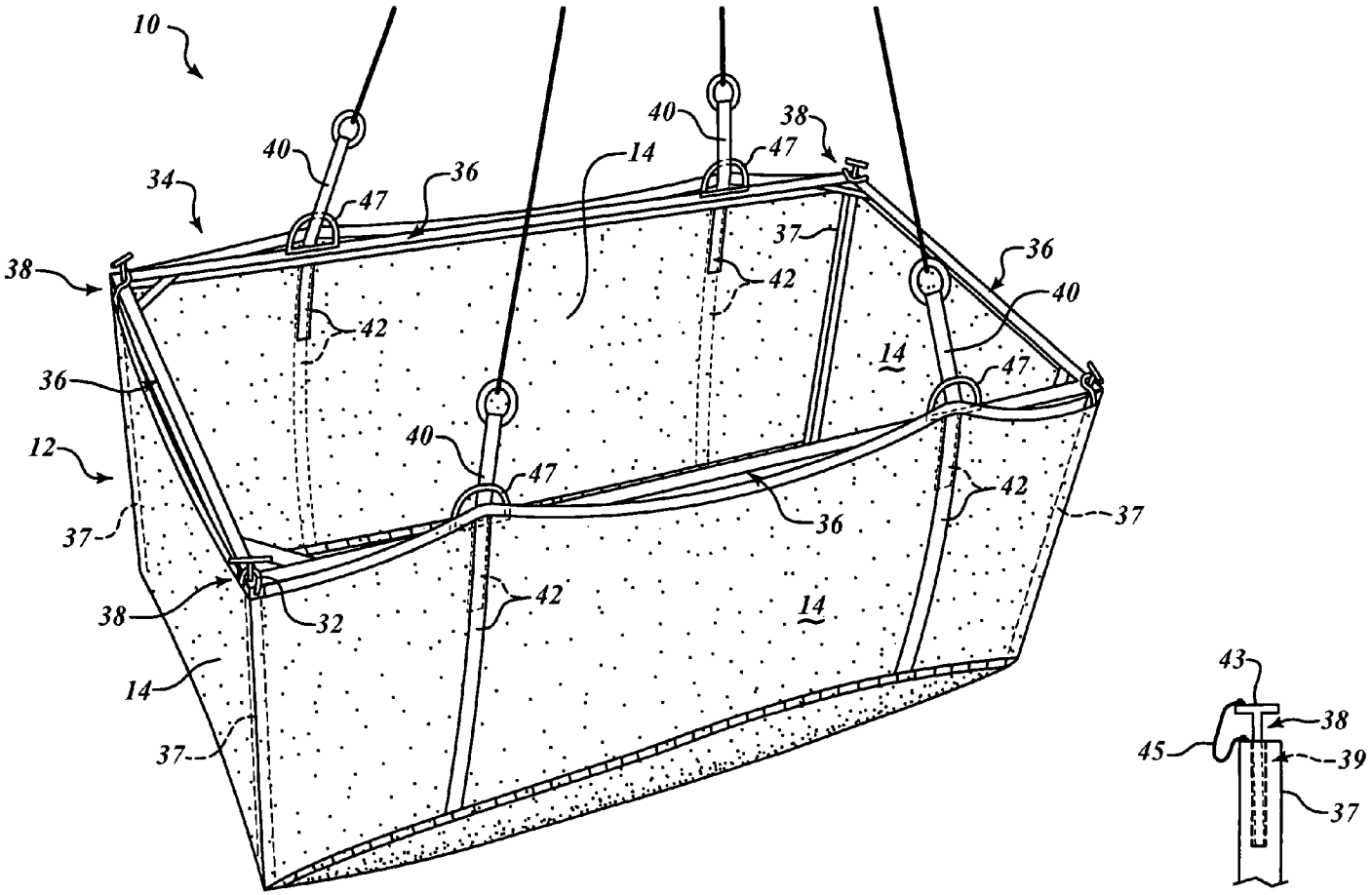

In some other embodiments and referring to FIG. 2E, in some applications the bottom-dumping flexible container 10 may be suspended aloft to abut an opening in a structure where debris can be loaded, such as scaffolding, windows, sliding doors, or the like. In such applications, the bottom-dumping flexible container 10 may be kept open and its shape substantially maintained by an aerial frame 34. The aerial frame 34 is a rigid frame that is received within the top section 12. Horizontal frame members 36, are attached to each other, such as by welding, to form the aerial frame 34 into a shape that approximates a desired shape of the opening of the top portion 12, such as without limitation a substantially rectangular shape. Vertical frame members 37 are attached, such as by welding, to the horizontal frame members 36 at corners of the aerial frame 34. When the aerial frame 34 is received within the bottom-dumping flexible container 10 the vertical frame members 37 extend vertically into the bottom-dumping flexible container 10. Referring additionally to FIG. 2F, engagement devices 38 removably engage the hooks 32, thereby removably attaching the flexible side members 14 to the aerial frame 34. The engagement devices 38 extend upwardly from the aerial frame 34 at any angle as desired and at any location on the aerial frame 34 as desired. For example, in some embodiments, the engagement devices 38 extend upwardly from corners of the aerial frame 34. In some embodiments, the engagement device 38 may be removably received within the hook 32. In such a case, an opening 39 may be defined downwardly at any angle as desired into the vertical frame member 37 from a top surface of the vertical frame member 37. The hook 32 is arranged to surround the opening 39 and the engagement device 38 is placed within the hook 32 and into the opening 39. In some embodiments, the engagement device may have a cross member 43 that can provide for ease of handling and that can also help prevent the hook 32 from slipping off the engagement device 38. In some embodiments, if desired an attachment member 45, such as without limitation a chain or cable or rope or string or the like, can attach the engagement device 38 to the aerial frame 34 to help prevent inadvertent loss of the engagement device 38. In some other embodiments, the hook 32 may be looped over the engagement device 38. In such a case, the engagement device 38 may be removably attachable to the aerial frame 34, such as described above, or the engagement device 38 may be attached to the aerial frame 34 by welding or with a fastener, as desired.

Referring now to FIGS. 2D and 2E, in some embodiments transport loops 40 extend from support straps 42 that are attached to the flexible side members 14. The transport loops 40 and the support straps 42 suitably are made from nylon webbing or the like. The support straps 42 are attached to the flexible side members 14 by a suitable technique, such as sewing. The support straps 42 may be provided along a portion or substantially all of the height of the interior and/or exterior surfaces of the flexible side members 14 as desired. For example and as shown in FIG. 2E for illustration purposes only and not by way of limitation, the support straps 42 can be provided along substantially all of the height of the exterior surfaces of the flexible side members 14 and can also extend along a portion of the height of the interior surfaces of the flexible side members 14. If desired, guide rings 47, such as D-rings, may be attached to an upper surface of the horizontal frame members 36 in the vicinity of the transport loops 40, and in such a case the transport loops 40 may be threaded through the guide rings 47. The transport loops 40 are configured to releasably engage a connection device of a transport device for transporting the container. For example, the transport loops 40 may engage attachment devices of a crane (as shown in FIG. 2E for illustration purposes only), forks of a forklift, or the like.

Referring briefly back to FIG. 1A, one or more loops 41 may be attached to any one or more of the flexible side members 14 toward the bottom section 16 and/or the flexible bottom members 18 toward the top section 12. The loops 41 suitably are made from nylon webbing or the like. A tag line 43 can be attached to any of the loops 41 to permit an operator, such as a rigger, to guide movement or positioning of the bottom-dumping flexible debris container 10 while it is being transported, such as being lifted or lowered.

Figure 3:
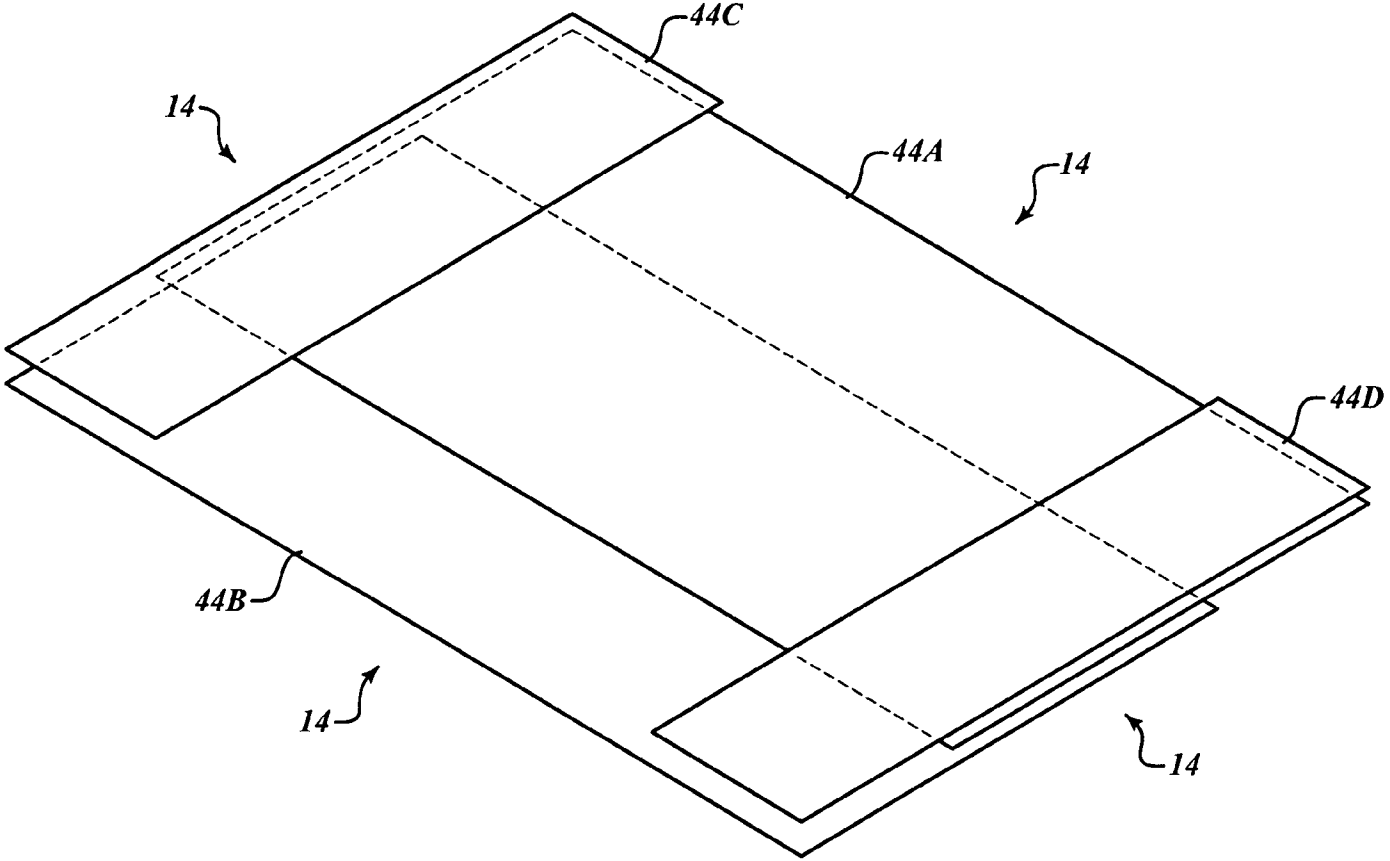
FIG. 3 is a top plan view of illustrative flexible flap members of a bottom-dumping flexible debris container.

Referring now to FIG. 3, in some embodiments flexible flap members 44A, 44B, 44C, and 44D may be hingedly attached to interior surfaces of the flexible side members 14 at a lower region of the flexible side members 14 (that is, at a region proximate the bottom section 16 (not shown in FIG. 3)). The flexible flap members 44A, 44B, 44C, and 44D are sized to fold over and overlap each other to cover any gaps or openings that may exist between the flexible bottom members 18. Thus, overlapping of the flexible flap members 44A, 44B, 44C, and 44D could help prevent debris from escaping the bottom-dumping flexible debris container 10 (that is, during times when it is desired to contain debris within the bottom-dumping flexible debris container 10).

Figure 4A:
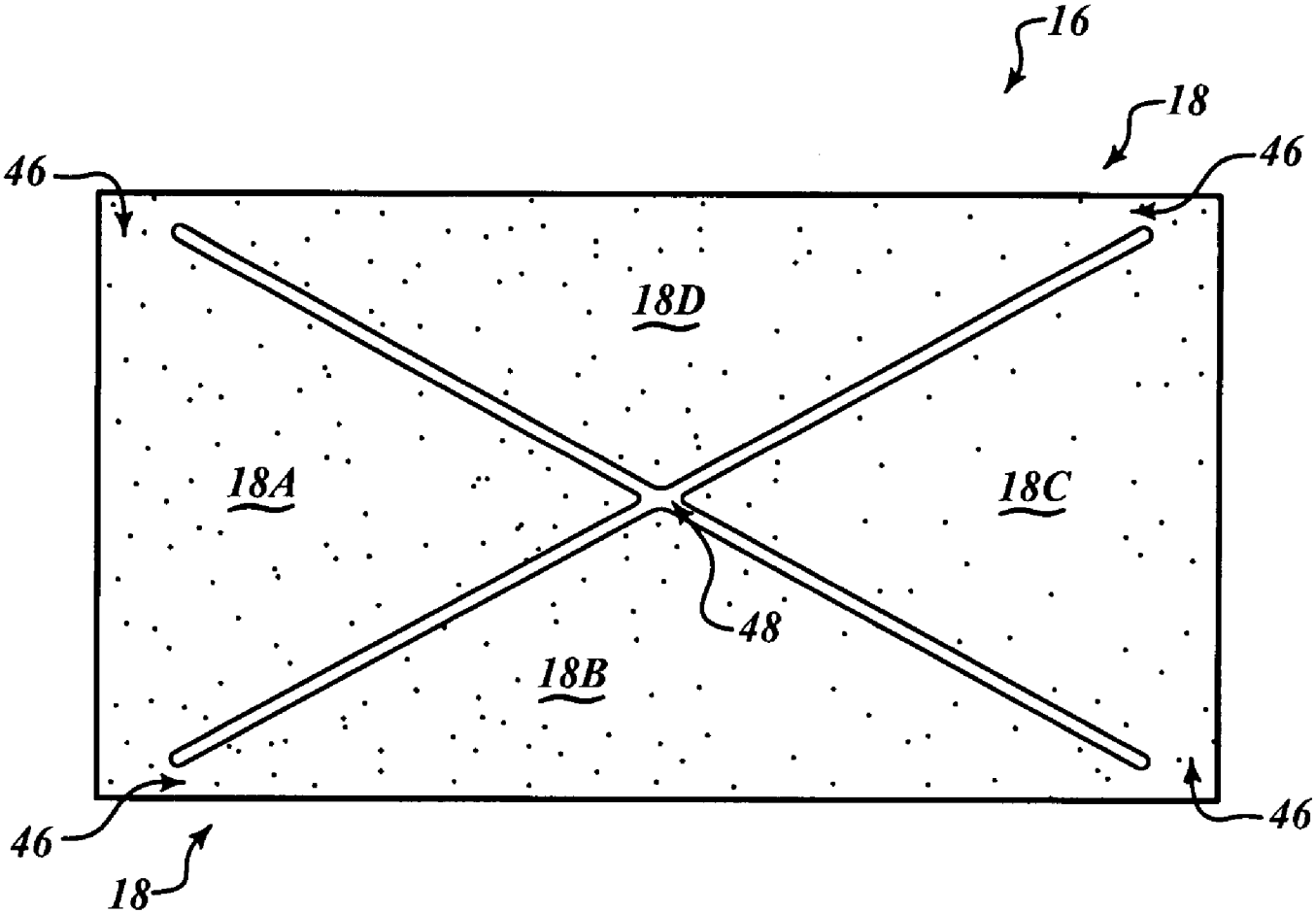
FIGS. 4A and 4B are bottom plan views of illustrative flexible bottom members of a bottom-dumping flexible debris container.
Figure 4B:
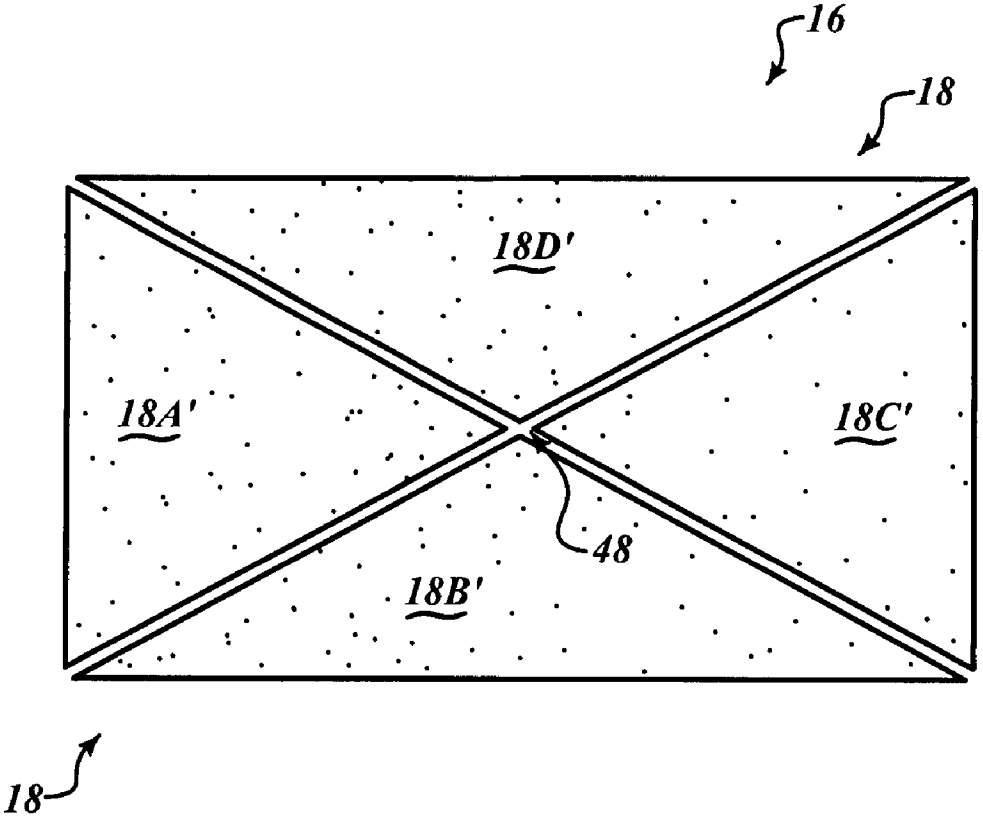

Referring to FIGS. 4A and 4B, the bottom section 16 includes the flexible bottom members 18. As shown in FIG. 4A, in some embodiments the flexible bottom members 18 may be provided as sections 18A, 18B, 18C, and 18D that are cut from a single piece of flexible material. In some embodiments, mesh materials, such as vinyl coated polyester mesh material, may be used. However, it will be appreciated that any flexible material, such as without limitation fabric, polyester, plastic, or the like, may be used as desired for a particular application. A border 46 of the flexible material surrounds the sections 18A, 18B, 18C, and 18D. As will be discussed below, the sections 18A, 18B, 18C, and 18D can be releasably attached to each other at a central region 48 of the bottom section 16. The border 46 can act as a hinge that permits the sections 18A, 18B, 18C, and 18D to be urged gravitationally downward when the sections 18A, 18B, 18C, and 18D are released from attachment to each other at the central region 48. While the sections 18A, 18B, 18C, and 18D are shown as having triangular shapes, it will be appreciated that the sections 18A, 18B, 18C, and 18D may have any shape as desired. Moreover, while the bottom section 16 is shown as being sectioned into four sections 18A, 18B, 18C, and 18D, it will also be appreciated that the bottom section 16 may be sectioned into as many sections as desired.

As shown in FIG. 4B, in some other embodiments the flexible bottom members 18 may be provided as separate flexible bottom members 18A', 18B', 18C', and 18D' that are separate pieces of flexible material. In some embodiments, mesh materials, such as vinyl coated polyester mesh material, may be used. However, it will be appreciated that any flexible material, such as without limitation fabric, polyester, plastic, or the like, may be used as desired for a particular application. Similar to the sections 18A, 18B, 18C, and 18D (all FIG. 4A), the flexible bottom members 18A', 18B', 18C', and 18D' can be releasably attached to each other at the central region 48 (as will be discussed below). The flexible bottom members 18A', 18B', 18C', and 18D' are hingedly attached to the flexible side members 14 (not shown in FIG. 4B) as discussed below.

Figure 5:
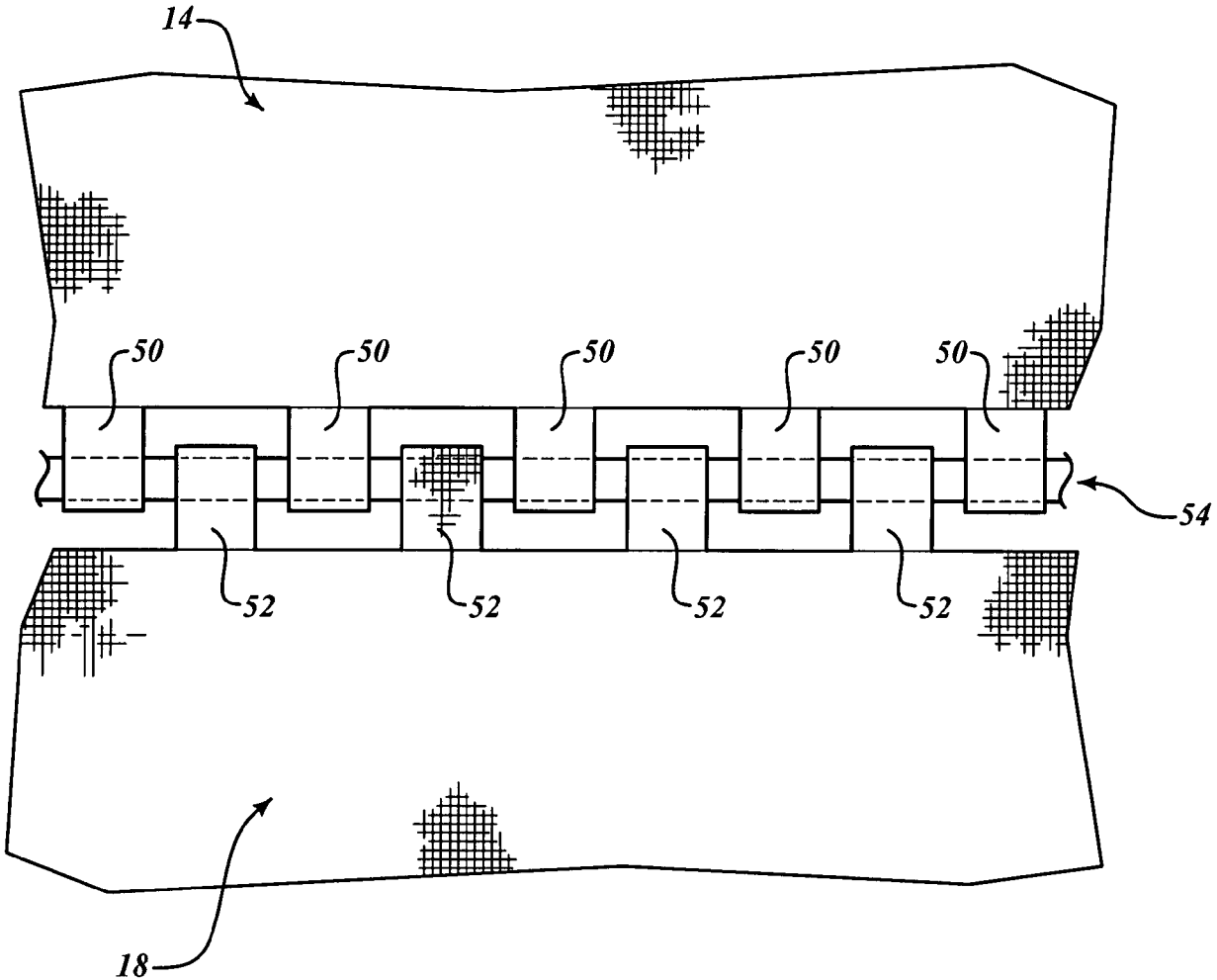
FIG. 5 is a side plan view in partial schematic form of details of an illustrative arrangement for hingedly attaching the flexible side members and the flexible bottom members.

Referring now to FIG. 5, the flexible bottom members 18 are hingedly attached to the flexible side members 14. The flexible side members 14 may be hingedly attached to the border 46 (FIG. 4A) or the separate flexible bottom members 18A', 18B'; 18C', and 18D' (FIG. 4B). Regardless of how the flexible bottom members 18 are embodied, hinged attachment to the flexible side members 14 can be effected in the same manner. Thus, for sake of clarity and brevity, reference need only be made to the flexible bottom members 18.

The flexible side members 14 include connector loops 50. The connector loops 50 suitably are made from nylon webbing or the like. The flexible bottom members 18 include connector loops 52 that alternate with the connector loops 50 such that the connector loops 50 are adjacent the connector loops 52. The connector loops 52 suitably are made from nylon webbing or the like. At least one connector member 54 is threaded through the connector loops 50 and the connector loops 52. One contiguous connector member 54 may be used or more than one connector member 54 may be used, as desired. The connector member 54 suitably may be any connector member as desired for a particular application. For example, the connector member 54 may include without limitation: line, such as a rope or cord or the like; a tube or pipe, such as a solid tube or pipe or a hollow tube or pipe; a strut or beam or bar or angle-iron; or the like.

Figure 6A:
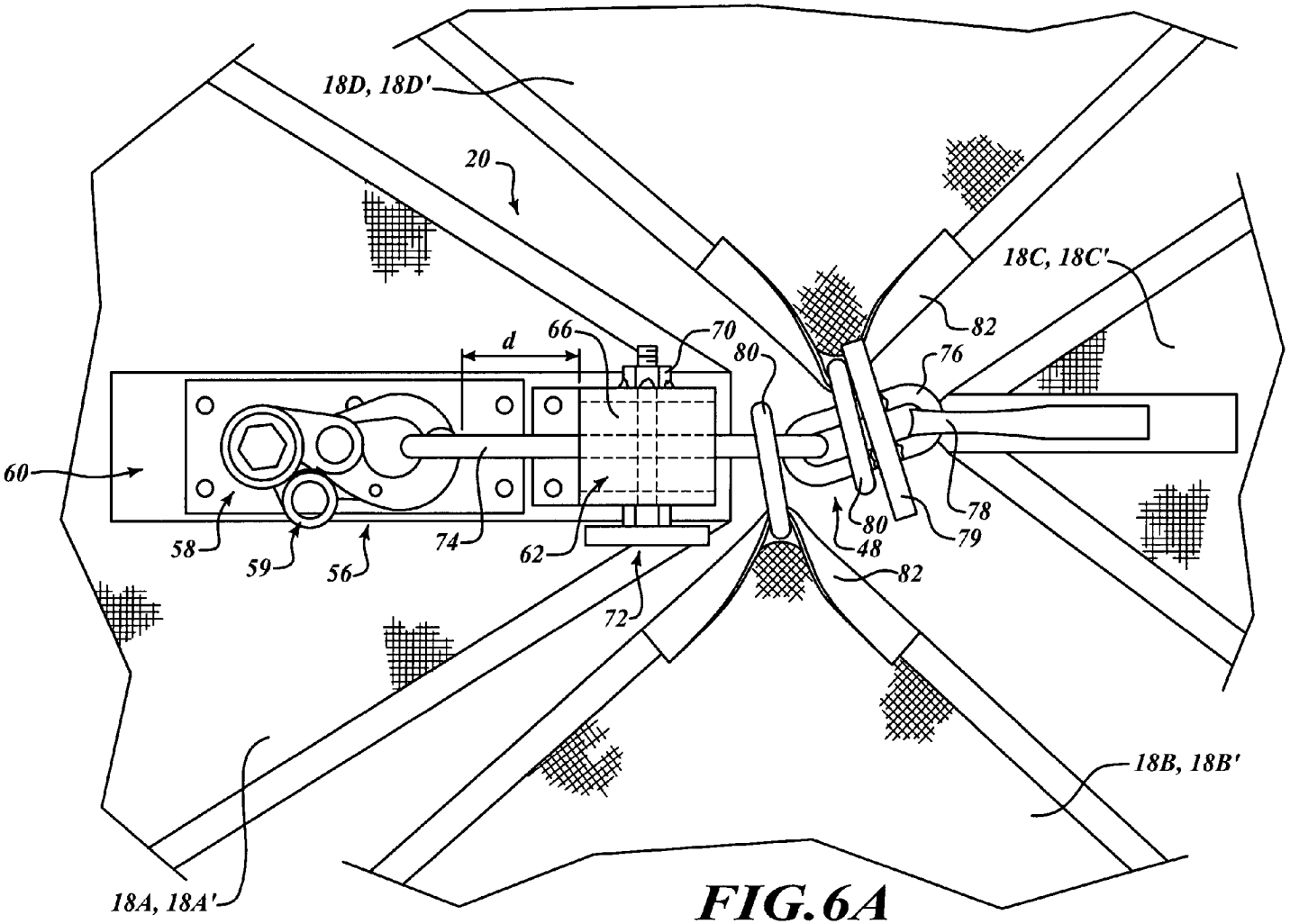
FIGS. 6A-6F illustrate details of a release mechanism.

Referring now to FIG. 6A, the release mechanism 20 is configured to releasably attach the flexible bottom members 18 to each other. The release mechanism 20 is provided on exterior surfaces of the flexible bottom members 18. Regardless of how the flexible bottom members 18 are embodied, construction and operation of the release mechanism 20 can be effected in the same manner.

Figure 6B:
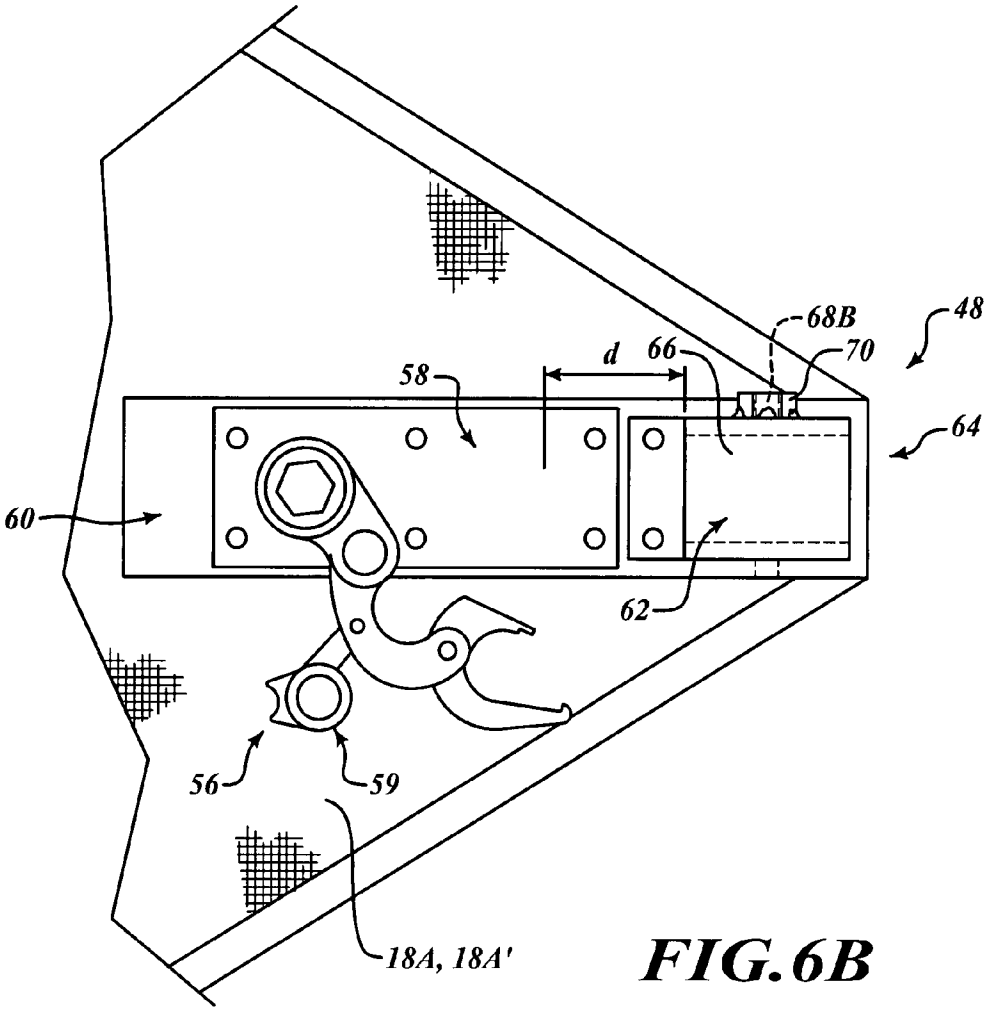

Referring additionally to FIG. 6B, the release mechanism 20 includes a release hook 56. The release hook 56 may be any suitable type of hook that is openable and closable, such as a pelican hook or the like. Given by way of non-limiting example, a suitable release hook includes a "Release-A-Matic" hook, model number H44-3, available from Peck & Hale of West Sayville, N.Y. The release hook 56 has an opening path of travel d associated with it. That is, the release hook 56 sweeps across a distance (the opening path of travel d) while opening from a closed position to an open position.

The release hook 56 is mounted on a rigid spacing assembly 58 at the central region 48. The rigid spacing assembly 58 is configured to maintain the opening path of travel d substantially free from interference as the release hook 56 sweeps through the opening path of travel d during opening of the release hook 56. The rigid spacing platform 58 helps maintain a substantially constant relative spatial relationship along the opening path of travel d as the release hook 56 sweeps though its opening motion, thereby helping maintain the opening path of travel d substantially free from interference from buckling and the like. The release hook 56 suitably is launched open by application of a pulling force at a force point 59. The pulling force may be applied via a line, such as a rope or cord or the like (not shown) that may be attached to the force point 59.

If desired, the rigid spacing platform 58 may be mounted, such as by bolting or riveting or the like, on a reinforcing layer 60, such as nylon webbing or the like, that is in turn attached to an exterior surface of the flexible bottom member 18, such as by sewing. Another reinforcing layer 60 (not shown) may be provided on an interior surface of the flexible bottom member 18. In such a case, the reinforcing layers may be sewn together with the flexible bottom member 18 disposed therebetween. In some embodiments, the release hook 56- and the rigid spacing assembly 58 may be mounted on an exterior surface of the flexible bottom member 18A or 18A'. However, it will be appreciated that the release hook 56 and the rigid spacing assembly 58 need not be mounted to the flexible bottom member 18A or 18A' but may be attached to any of the flexible bottom members 18 as desired.

The release mechanism 20 suitably includes a frame 62 attached thereto toward an end 64 of the rigid spacing assembly 58 at the central region 48. The frame 62 can cooperate with other components of the release mechanism 20 (discussed below) to help keep the opening path of travel d free from interference as the release hook 56 sweeps through the opening path of travel d during opening of the release hook 56.

Figure 6C:
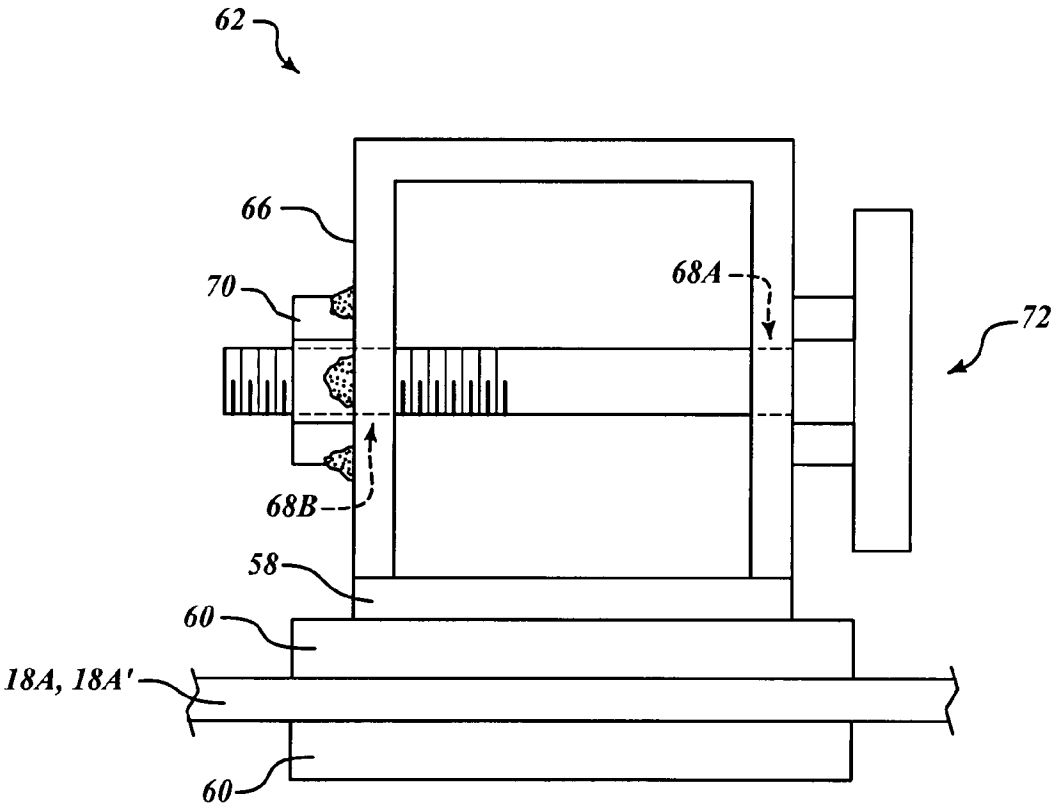

Referring additionally to FIG. 6C, in some embodiments the frame 62 includes a frame body 66. The frame body 66 defines holes 68A and 68B (shown in phantom). A threaded nut 70 is permanently attached, such as by welding, to the frame body 66 adjacent the hole 68B. A safety stop member 72, such as a bolt, can be received through the holes 68A and 68B and threadedly engaged with the nut 70. If desired, the safety stop member 72 can also be releasably retained in place with a clip (not shown), a cotter pin (not shown) or the like instead of being threadedly received in the nut 70.

Figure 6D:
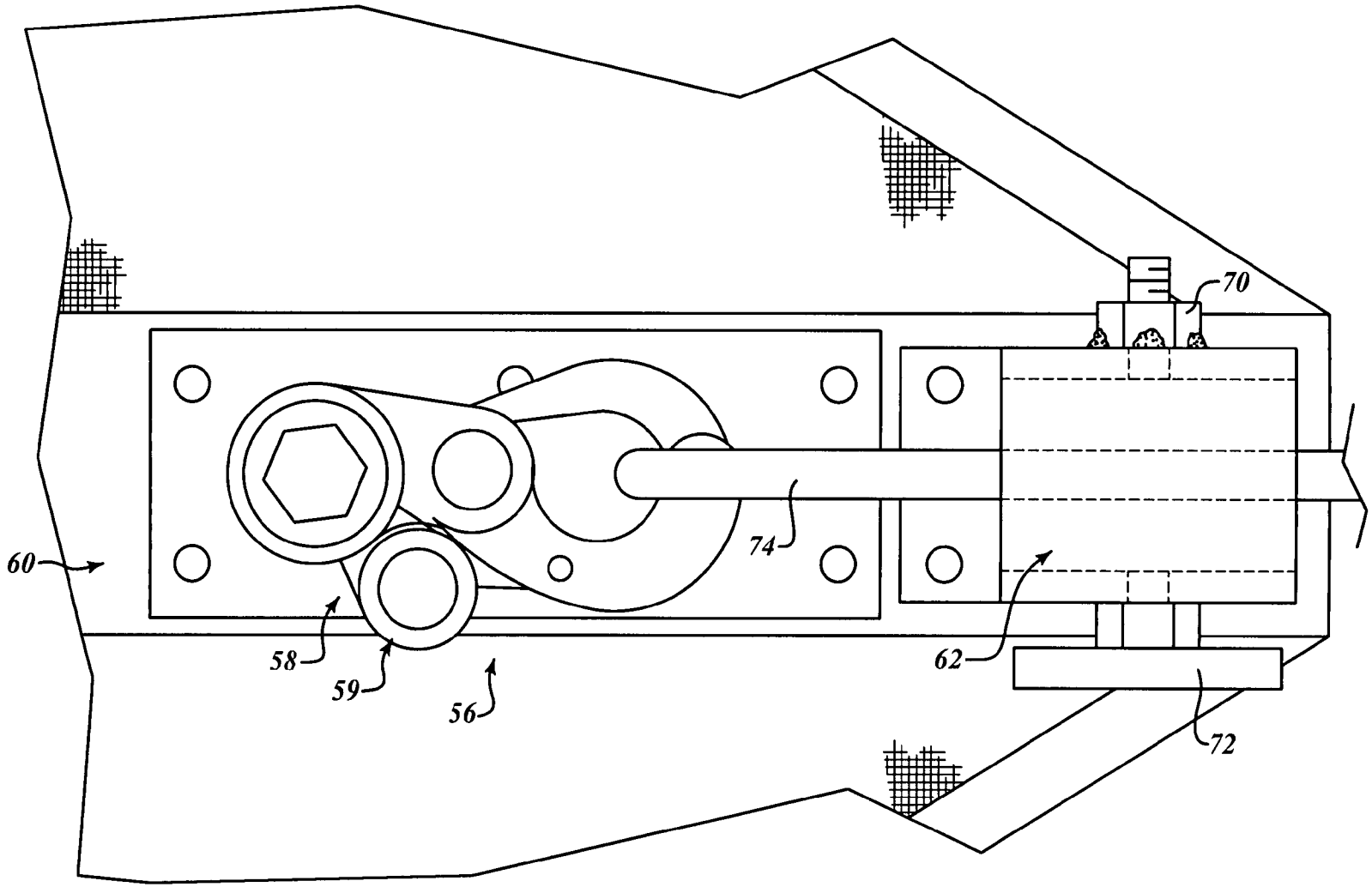
Figure 6E:
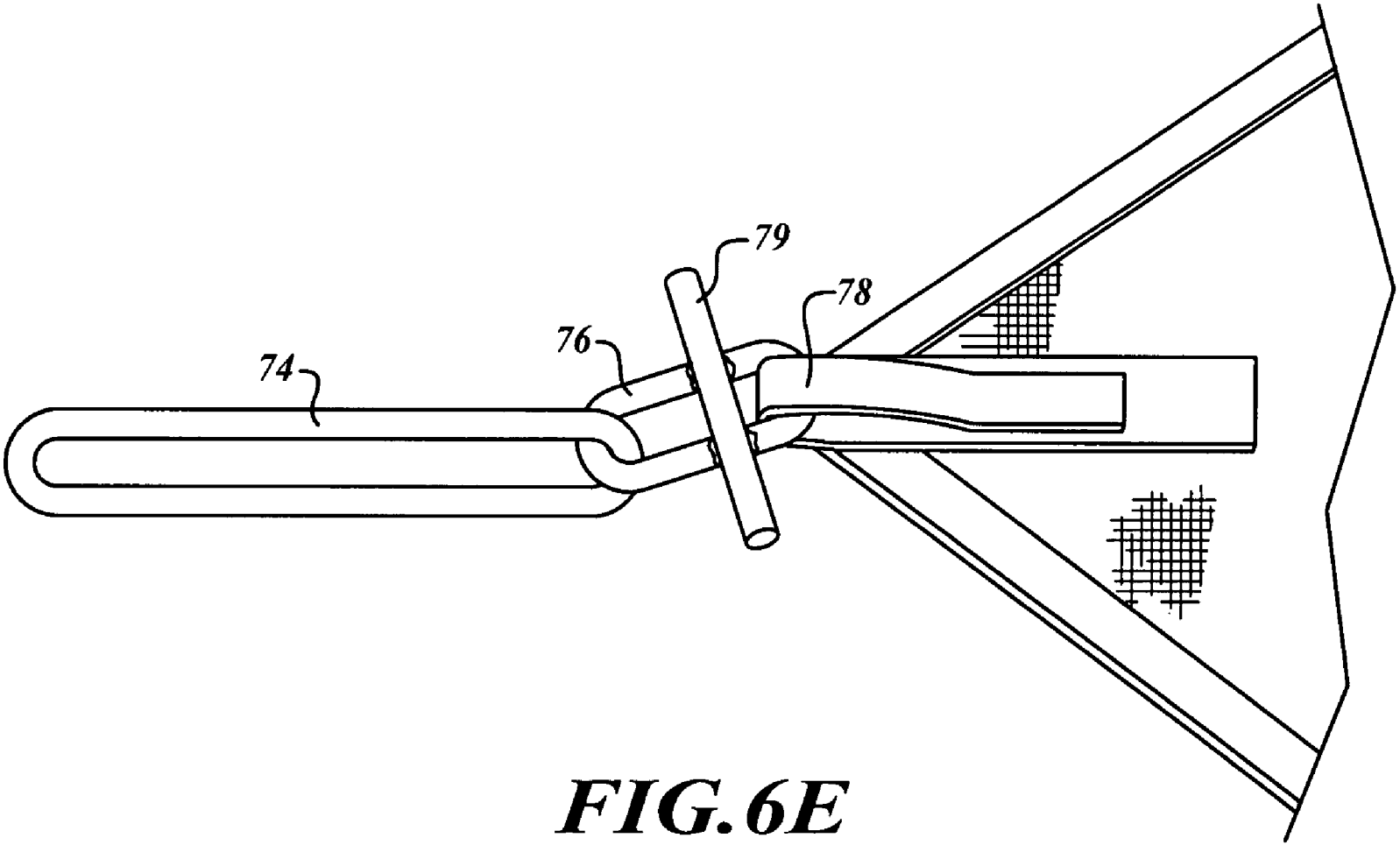

Referring additionally to FIGS. 6D and 6E, an elongated link 74 can be operatively coupled to another of the flexible bottom members 18, such as the flexible bottom member 18C or 18C'. In some embodiments, the elongated link 74 may be linked to a link 76 that is, in turn, attached to the flexible bottom member 18C or 18C'. If desired, the link 76 may be attached to a loop 78 of reinforcing fabric material, such as nylon webbing or the like, that is attached, such as by sewing, to the flexible bottom member 18C or 18C' at the central region 48. In some embodiments, a safety stop bar 79 may be attached, such as by welding, to the link 76. The safety stop bar 79 has a length that is longer than a width of an opening in the frame 62. The elongated link 74 is receivable through the frame 66 and is releasably attachable to the release hook 56. Because the safety stop bar 79 is longer than the width of the opening in the frame 62, the safety stop bar 79 can not pass through the opening in the frame 62. Thus, the safety stop bar 79 provides a limit to that which can be passed through the opening of the frame 62.

Figure 6F:
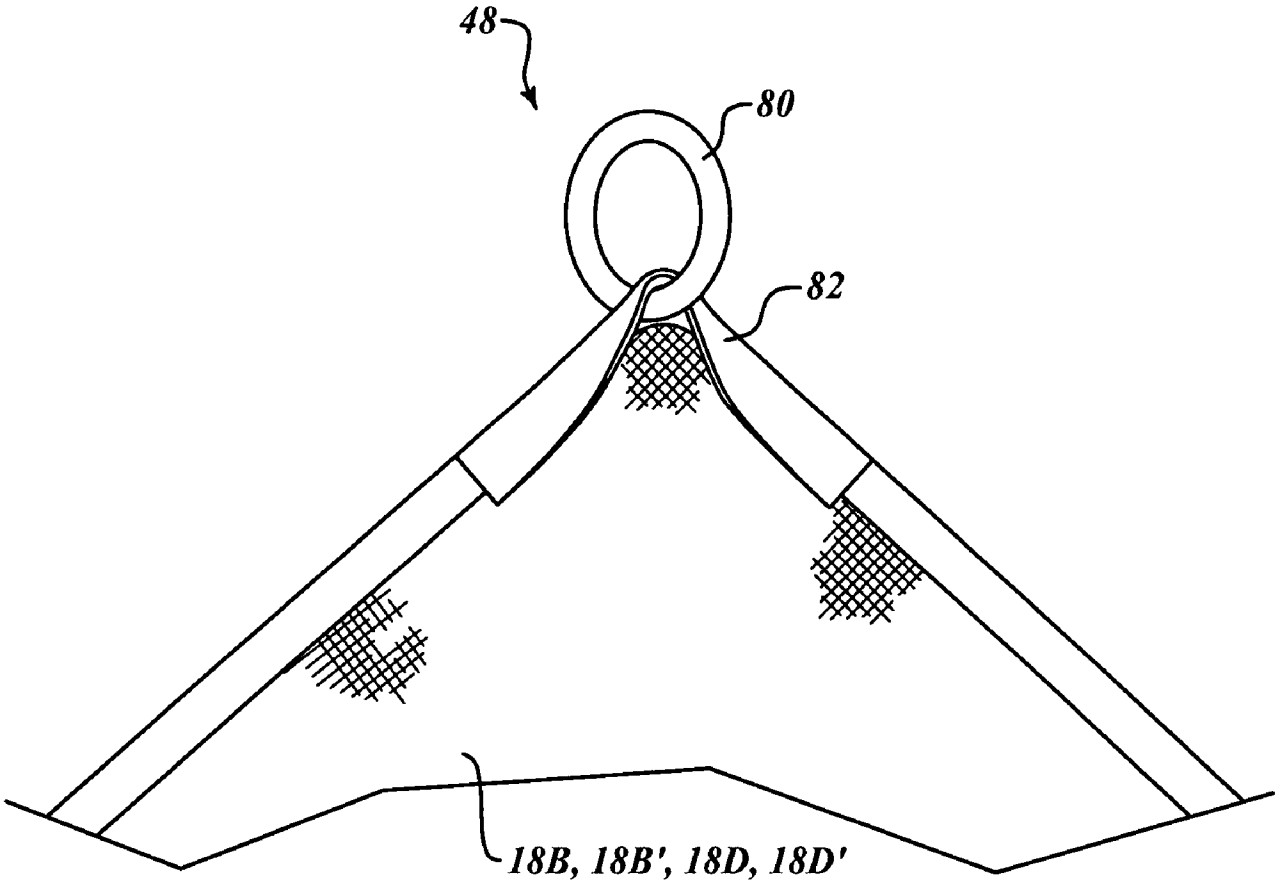

Referring additionally to FIG. 6F, rings 80 are attached to the flexible bottom members 18B or 18B' and 18D or 18D' at the central region 48. If desired, the rings 80 may be attached via loops 82 of reinforcing fabric material, such as nylon webbing or the like, that are attached, such as by sewing, to the flexible bottom members 18B or 18B' and 18D or 18D', as the case may be.

As shown in FIG. 6A, the elongated link 74 is receivable through each ring 80. The safety stop bar 79 provides a limit to that which can be passed through the opening of the frame 62. The elongated link 74 is received within the release hook 56. The safety stop member 72 can be received through the holes 68 in the frame body 66 and threadely received in the nut 70 to help prevent the elongated link from exiting the frame 62 and, in turn, help prevent the flexible bottom members 18 from being released from attachment to each other. Thus, the elongated link 74 is releasably secured by the release hook 56 and is secondarily secured by the safety stop member 72. That is, if the release hook 56 is actuated to release the elongated link 74, the safety stop member 72 will engage the elongated link 74, thereby precluding the elongated link 74 from exiting the frame 62.

Figure 7A:
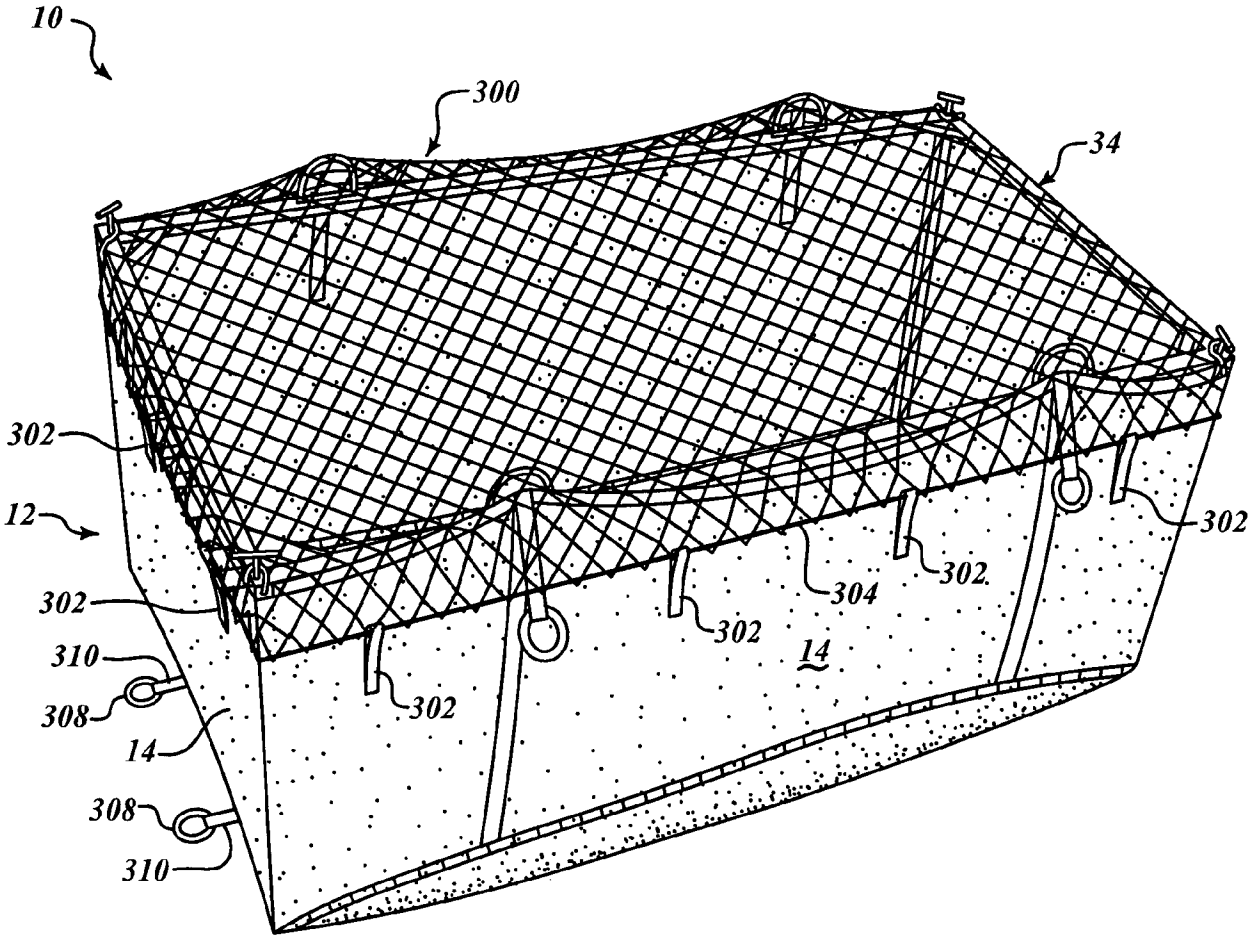
FIGS. 7A and 7B illustrate optional features of a bottom-dumping flexible debris container.
Figure 7B:
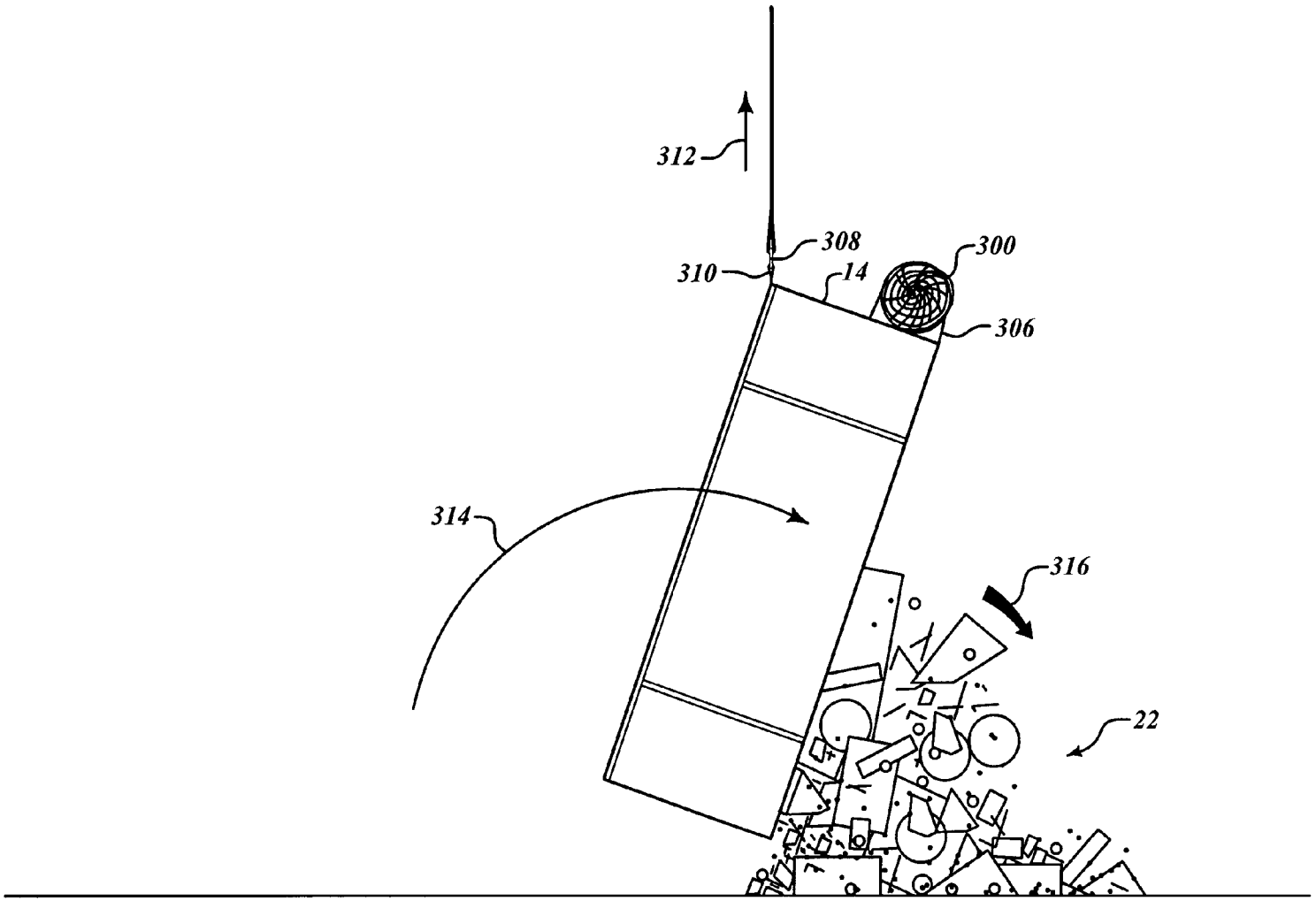

Referring now to FIGS. 7A and 7B, some optional features will now be discussed. If desired, a cover 300 may be provided, if desired. The cover 300 may be made of any material as desired for a particular application. In some embodiments, the cover 300 may be made of flexible material. For example, the cover 300 may be made of netting, a mesh material, plastic, or the like. In some embodiments, loops 302 are attached to an exterior surface of the flexible side members 14. In such embodiments, an attachment member 304, such as a rope, a cable, a chain, or the like, is provided around a periphery of the cover 300. In some embodiments, the attachment member 304 is threaded through the loops 302 and portions of the cover 300 to engage the cover 300 and the loops 302, thereby holding the cover 300 to the bottom-dumping flexible debris container. For example, the attachment member 304 may be threaded through matrix cells of netting (as shown in FIG. 7A). As another example when the cover 300 is provided as a mesh material or plastic or the like, the cover 300 may include attachment devices such as loops or the like (not shown) through which the attachment member 304 may be threaded.

Ends of the attachment member 304 may be secured in any manner as desired. For example, ends of the attachment member 304 may be secured to each other, such as by fastening with any fastener as desired, such as without limitation a C-link or the like. Ends of the attachment member 304 may be secured to one or more of the loops 302, such as by fastening with any fastener as desired, such as without limitation a C-link or the like. Ends of the attachment member 304 may be secured to one or more of the flexible side members 14, such as with hook-and-loop fasteners, snaps, or the like.

However, it will be appreciated that the cover 300 may be attached to the side flexible members 14 in any manner as desired for a particular application. For example, the cover 300 may also be attached to the flexible side members 14 with hook-and-loop fasteners, snaps, zippers, or the like. Further, the cover 300 is shown on an embodiment of the bottom-dumping flexible debris container 10 that includes the aerial frame 34 for illustration purposes only. It will be appreciated that the cover 300 need not be used in conjunction with the aerial frame 34. To that end, in some embodiments the cover 300 is used on the bottom-dumping flexible debris container 10 without the aerial frame 34.

As shown in FIG. 7B, if desired when not in use the cover 300 may be rolled up and stowed on an exterior surface of one of the flexible side members 14. When rolled up for stowage, the cover 300 may be held onto the exterior surface of one of the flexible side members 14 in any manner as desired. In some embodiments, the rolled-up cover 300 may be held in place with a member 306, such as a rope, lanyard, chain, strap, or the like. The member 306 may be attached to one of the flexible side members 14 in any manner as desired, such as looping through one or more of the loops 302.

As another optional feature, rings 308 may be provided, if desired, to enable a backup mode of emptying the bottom-dumping flexible debris container 10 if emptying the bottom-dumping flexible debris container 10 with the release mechanism 20 is unavailable. The rings 308 are attached to a attachment loops 310. In some embodiments, the attachment loops 310 are attached to a bottom portion of one of the flexible side members 14. In some other embodiments, the attachment loops 310 are attached to an exterior surface of one of the flexible bottom members 18 around a periphery of the flexible bottom member 18. As shown in FIG. 7B, attachment devices of a lifting device, such as a crane or the like, are attached to the rings 308. The lifting device lifts the bottom-dumping flexible debris container 10 via the rings 308, as indicated by arrow 312. Because the bottom-dumping flexible debris container 10 is lifted from only one end, the bottom-dumping flexible debris container 10 rotates, as indicated by arrow 314. As a result, the content 22 of the bottom-dumping flexible debris container 10 exits the open top of the bottom-dumping flexible debris container 10, as indicated by arrow 316.

Now that illustrative details have been set forth regarding some non-limiting examples of the bottom-dumping flexible debris container 10, illustrative methods for operating the bottom-dumping flexible debris container 10 and for manufacturing the bottom-dumping flexible debris container 10 will be explained.

Figure 8A:
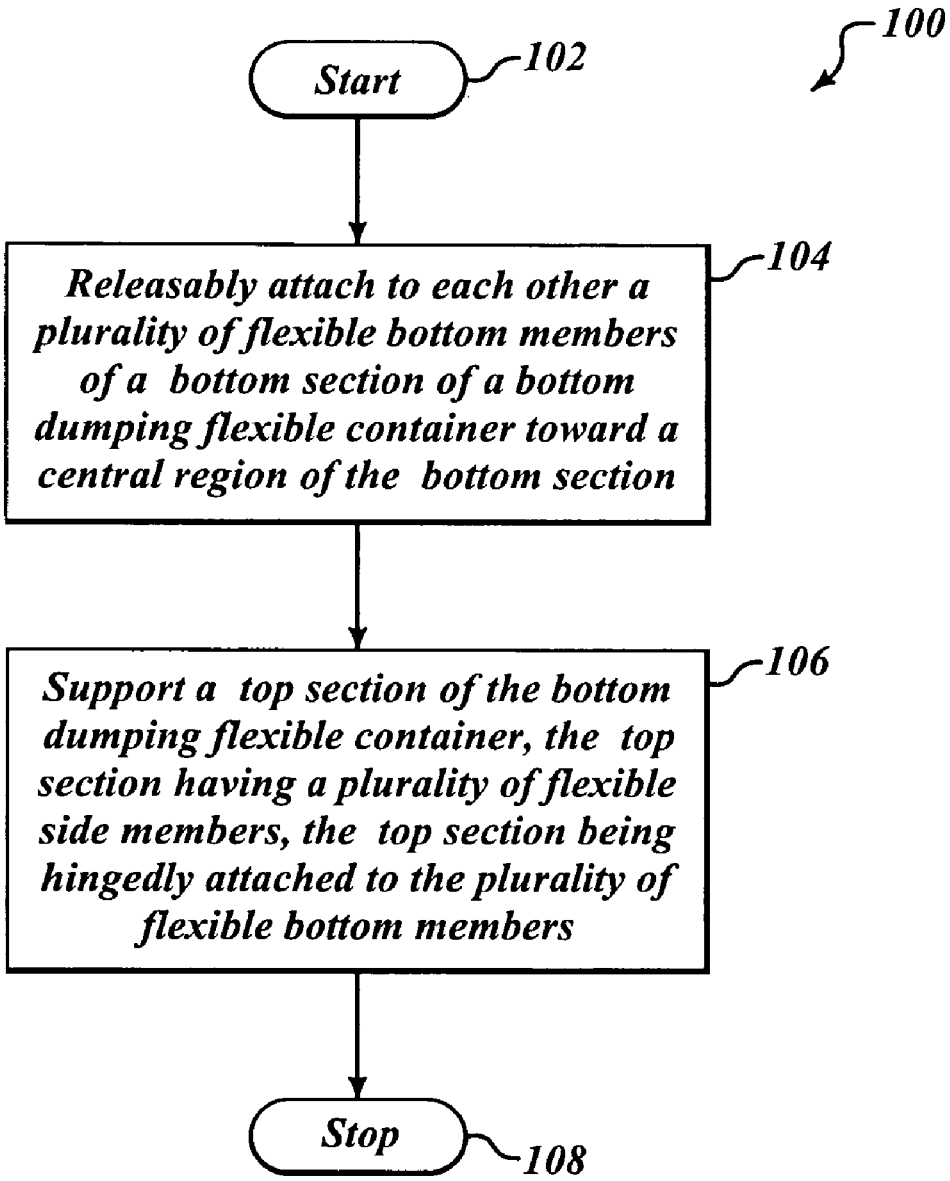
FIG. 8A is a flow chart of an illustrative method of using a bottom-dumping flexible debris container.

Referring now to FIG. 8A, an illustrative method 100 of using a bottom-dumping flexible container starts at a block 102. At a block 104 a plurality of flexible bottom members of a bottom section of a bottom-dumping flexible container are releasably attached to each other toward a central region of the bottom section. At a block 106 a top section of the bottom-dumping flexible container is supported, the top section having a plurality of flexible side members, the top section being hingedly attached to the plurality of flexible bottom members. The method 100 stops at a block 108.

Figure 8B:
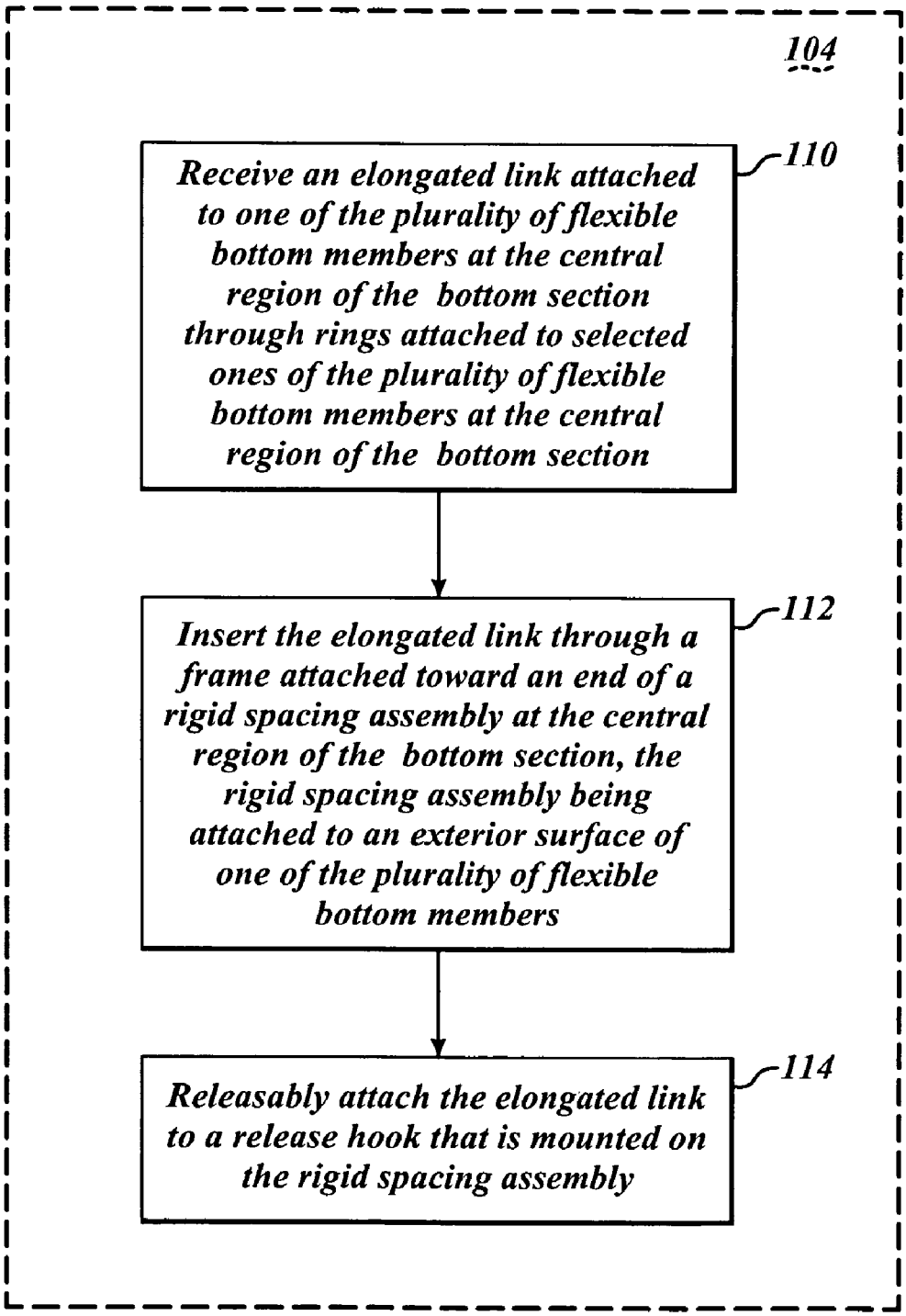
FIGS. 8B-8M are flow charts of details of the method of FIG. 8A.

Referring now to FIG. 8B, releasably attaching to each other a plurality of flexible bottom members of a bottom section of a bottom-dumping flexible container toward a central region of the bottom section at the block 104 can include receiving an elongated link attached to one of the plurality of flexible bottom members at the central region of the bottom section through rings attached to selected ones of the plurality of flexible bottom members at the central region of the bottom section at a block 110. In addition, at a block 112 the elongated link can be inserted through a frame attached toward an end of a rigid spacing assembly at the central region of the bottom section, the rigid spacing assembly being attached to an exterior surface of one of the plurality of flexible bottom members. Also, at a block 114 the elongated link can be releasably attached to a release hook that is mounted on the rigid spacing assembly.

Figure 8C:
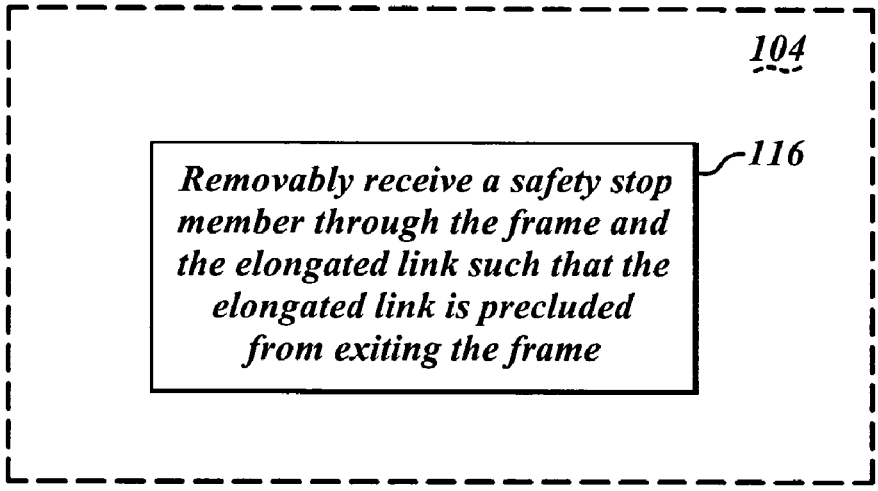

Referring now to FIG. 8C, releasably attaching to each other a plurality of flexible bottom members of a bottom section of a bottom-dumping flexible container toward a central region of the bottom section at the block 104 can includes removably receiving a safety stop member through the frame and the elongated link such that the elongated link is precluded from exiting the frame at a block 116.

Figure 8D:
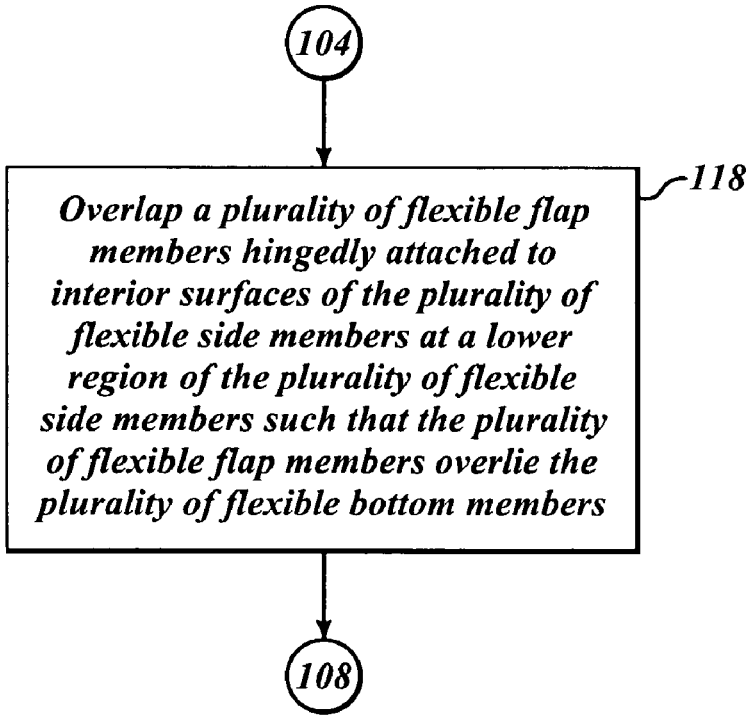

Referring now to FIG. 8D, at a block 118 a plurality of flexible flap members hingedly attached to interior surfaces of the plurality of flexible side members at a lower region of the plurality of flexible side members can be overlapped such that the plurality of flexible flap members overlie the plurality of flexible bottom members.

Figure 8E:
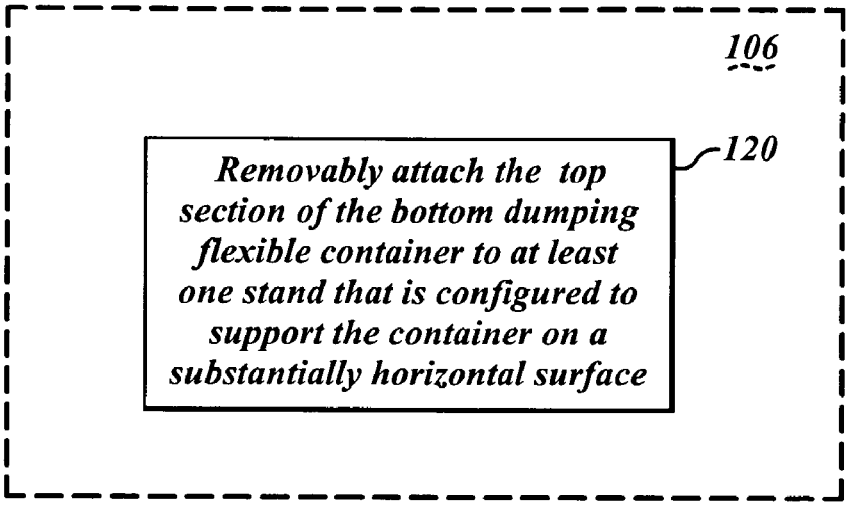

Referring now to FIG. 8E, supporting a top section of the bottom-dumping flexible container at the block 106 can include removably attaching the top section of the bottom-dumping flexible container to at least one stand that is configured to support the container on a substantially horizontal surface at a block 120.

Figure 8F:
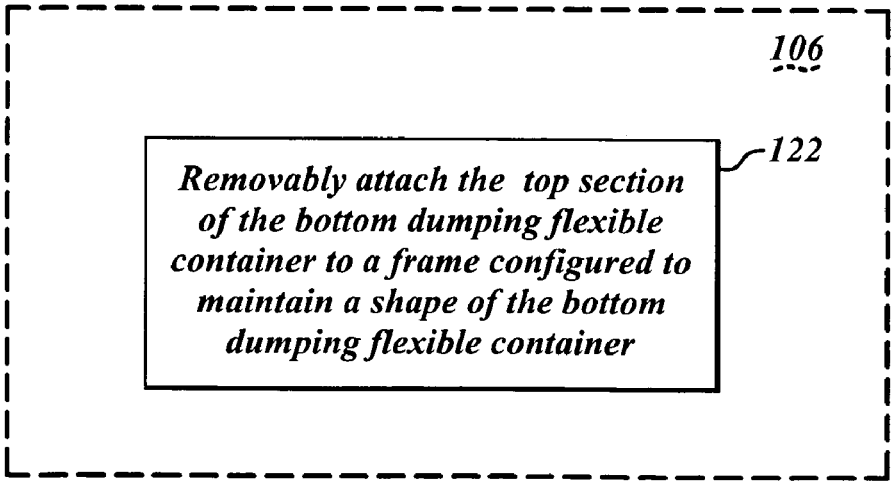

Referring now to FIG. 8F, supporting a top section of the bottom-dumping flexible container at the block 106 can include removably attaching the top section of the bottom-dumping flexible container to a frame configured to maintain a shape of the bottom-dumping flexible container at a block 122, such as when the bottom-dumping flexible container 10 is to be suspended aloft to abut an opening in a structure where debris can be loaded, such as scaffolding, windows, sliding doors, or the like.

Figure 8G:
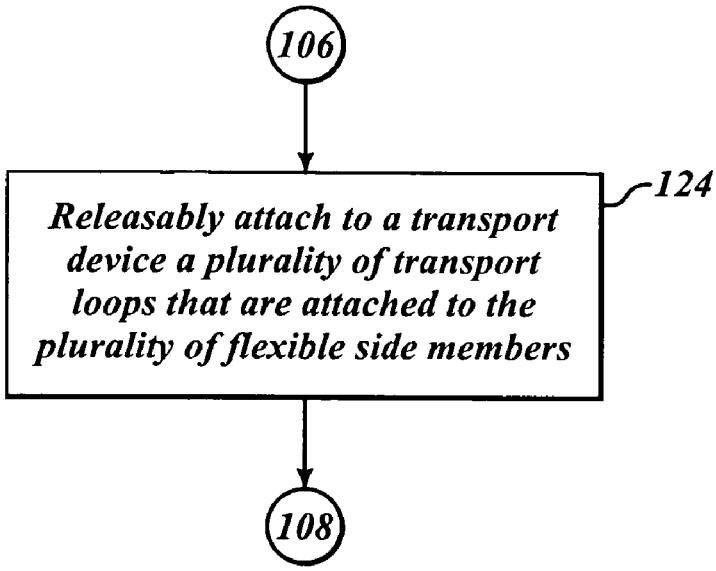
Figure 8H:
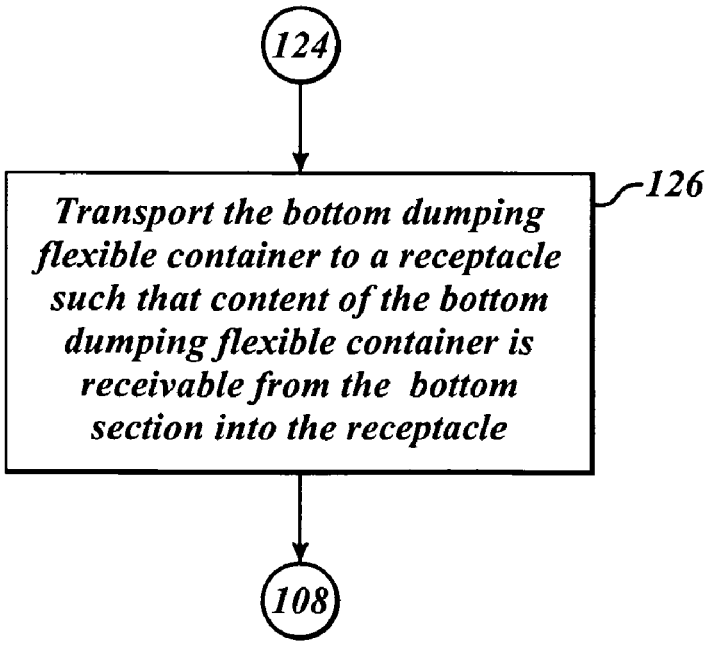

Referring now to FIG. 8G, at a block 124 a plurality of transport loops that are attached to the plurality of flexible side members can be releasably attached to a transport device. Referring now to FIG. 8H, at a block 126 the bottom-dumping flexible container can then be transported to a receptacle such that content of the bottom-dumping flexible container is receivable from the bottom section into the receptacle.

Figure 8I:
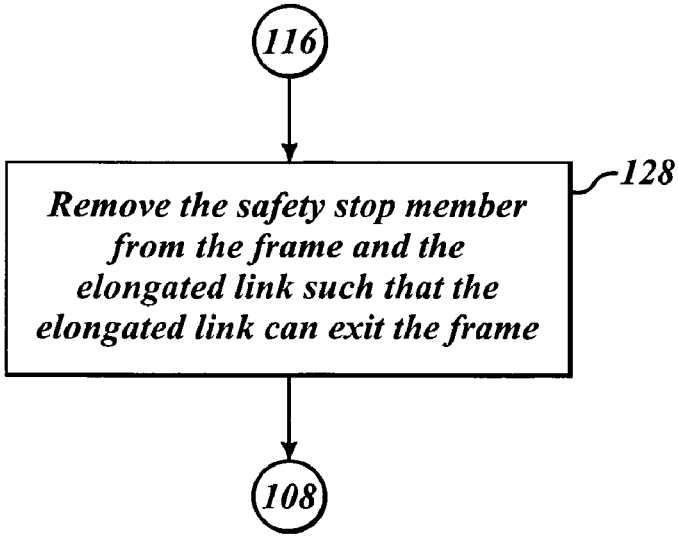

Referring now to FIG. 8I, at a block 128 the safety stop member can be removed from the frame and the elongated link such that the elongated link can exit the frame.

Figure 8J:
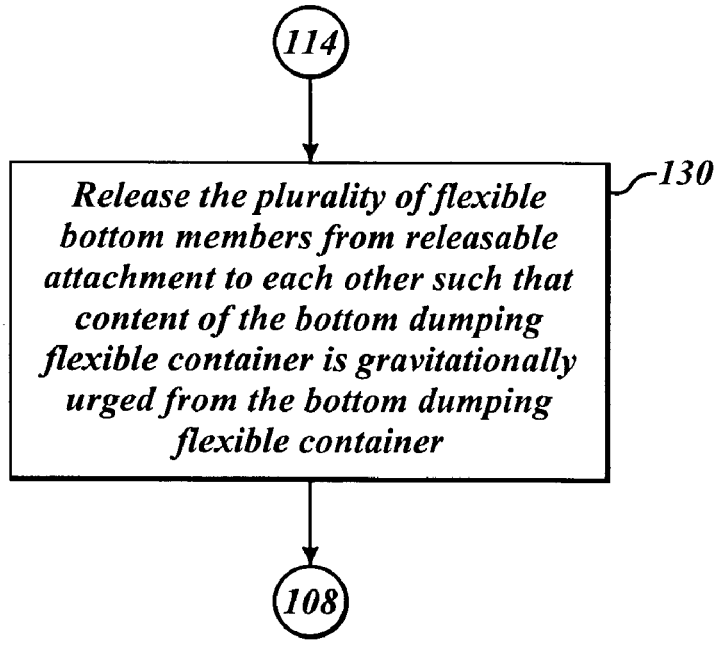
Figure 8K:
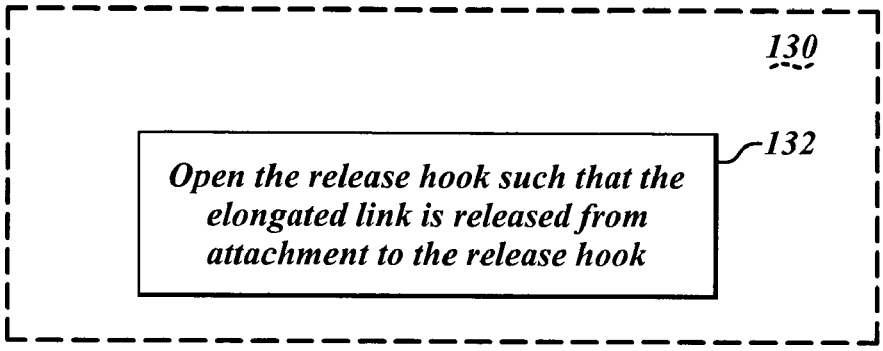

Referring now to FIG. 8J, at a block 130 the plurality of flexible bottom members can be released from releasable attachment to each other such that content of the bottom-dumping flexible container is gravitationally urged from the bottom-dumping flexible container. Referring now to FIG. 8K, releasing the plurality of flexible bottom members from releasable attachment to each other at the block 130 can include opening the release hook such that the elongated link is released from attachment to the release hook at a block 132.

Figure 8L:
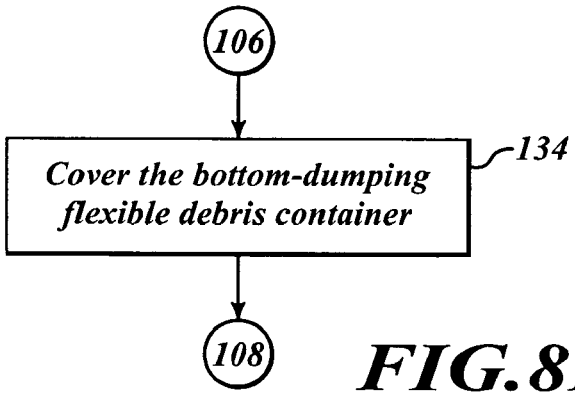
Figure 8M:
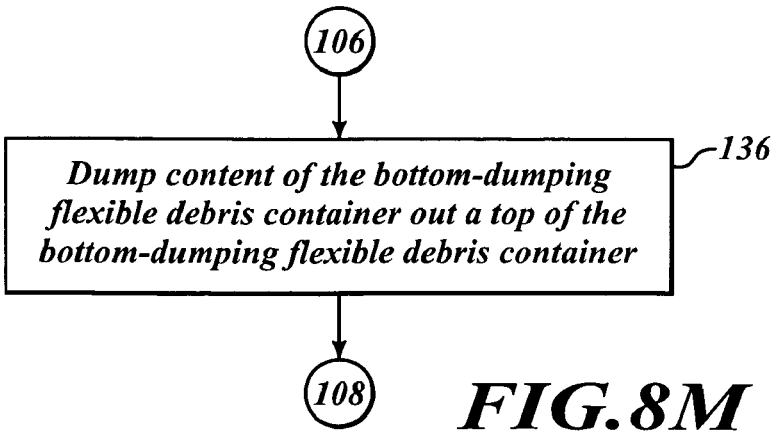

Referring now to FIG. 8L, if desired at a block 134 the bottom-dumping flexible debris container can be covered. Referring now to FIG. 8M, if desired at a block 136 content of the bottom-dumping debris container can be dumped out a top of the bottom-dumping flexible debris container. For example, content of the bottom-dumping debris container can be dumped out the top of the bottom-dumping flexible debris container at the block 136 when dumping the content of the bottom-dumping debris container is unavailable.

Figure 9A:
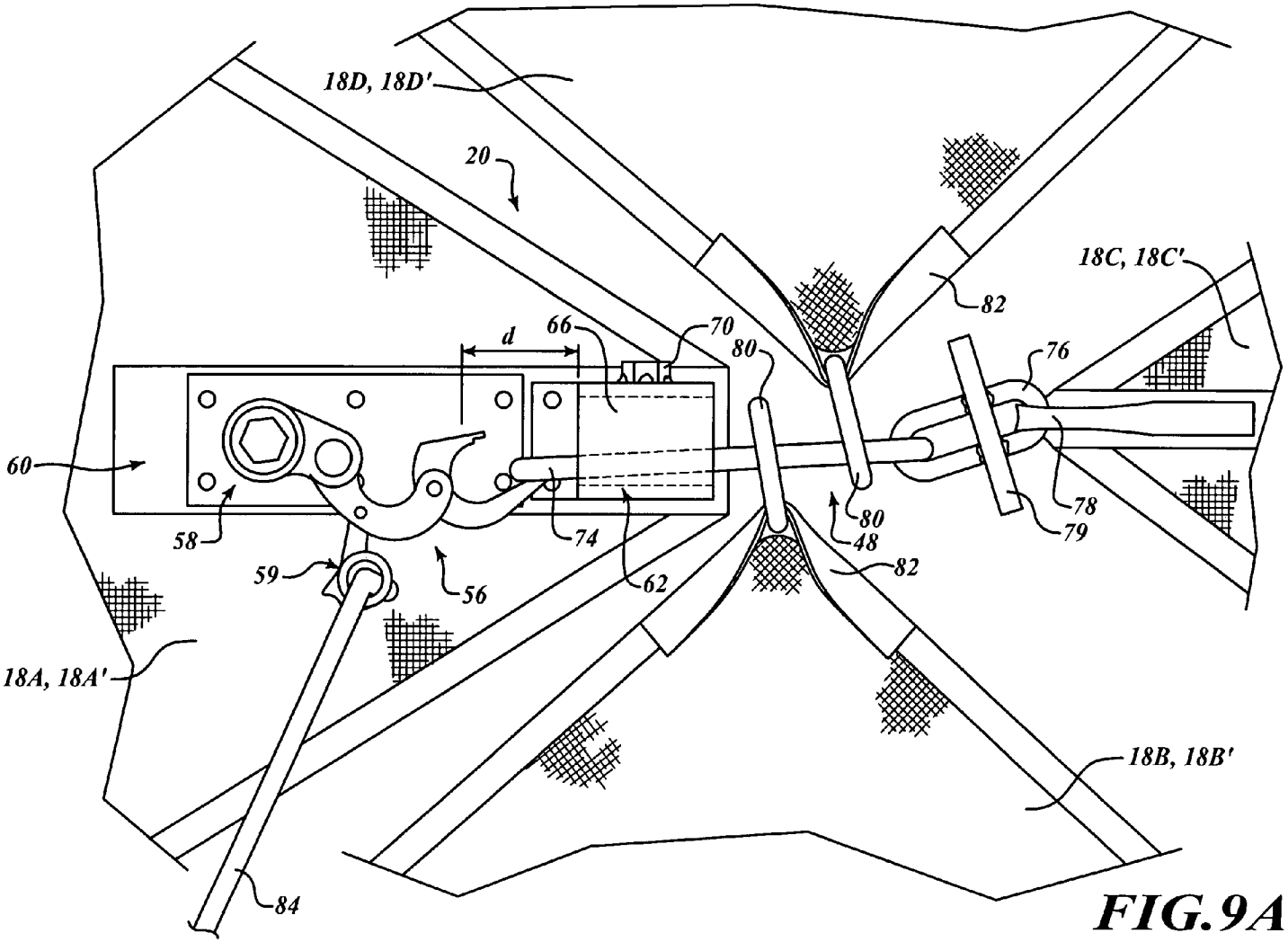
FIGS. 9A-9C are bottom plan views illustrating cooperation of flexible bottom members and components of a release mechanism.
Figure 9B:
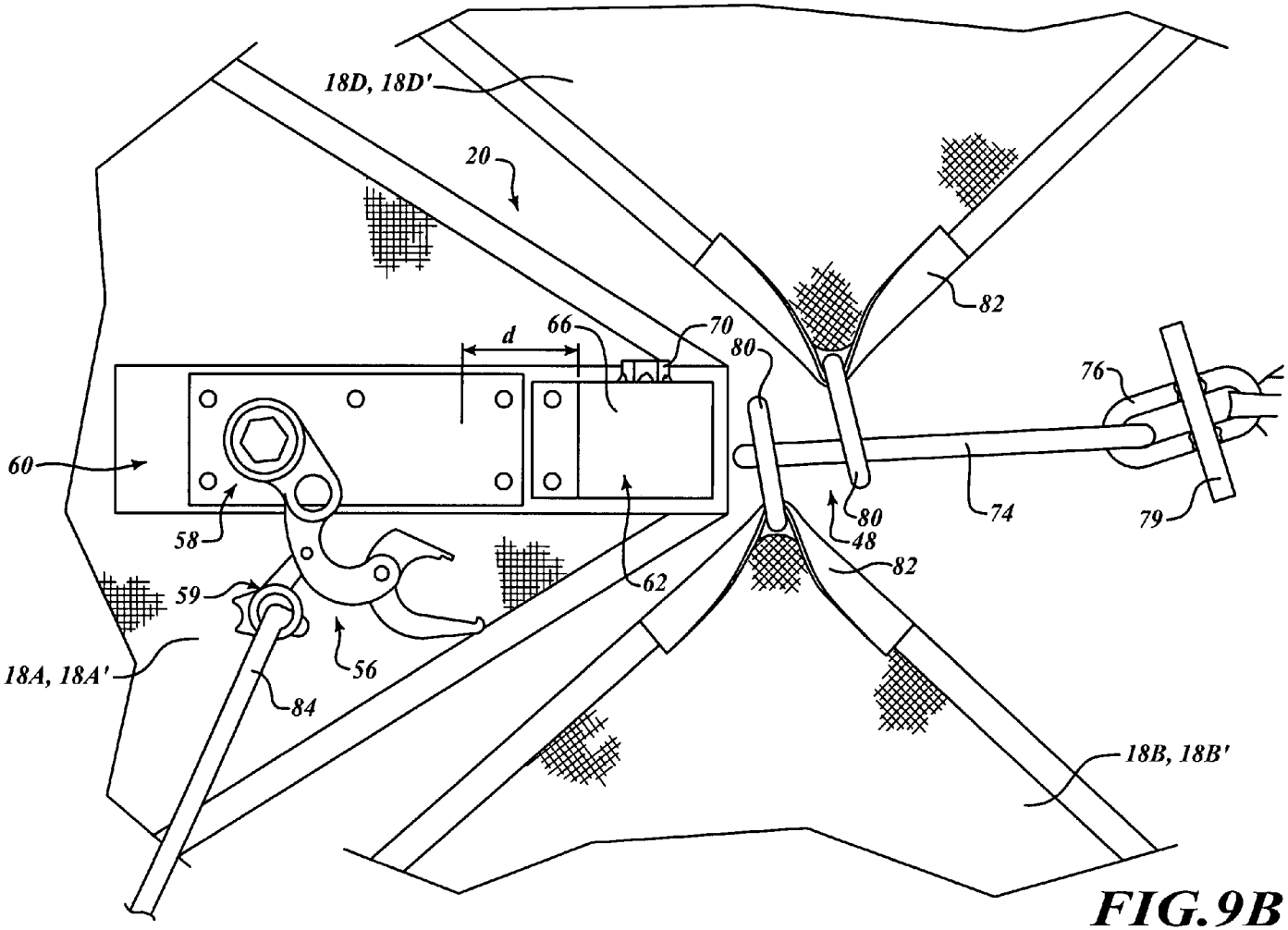
Figure 9C:
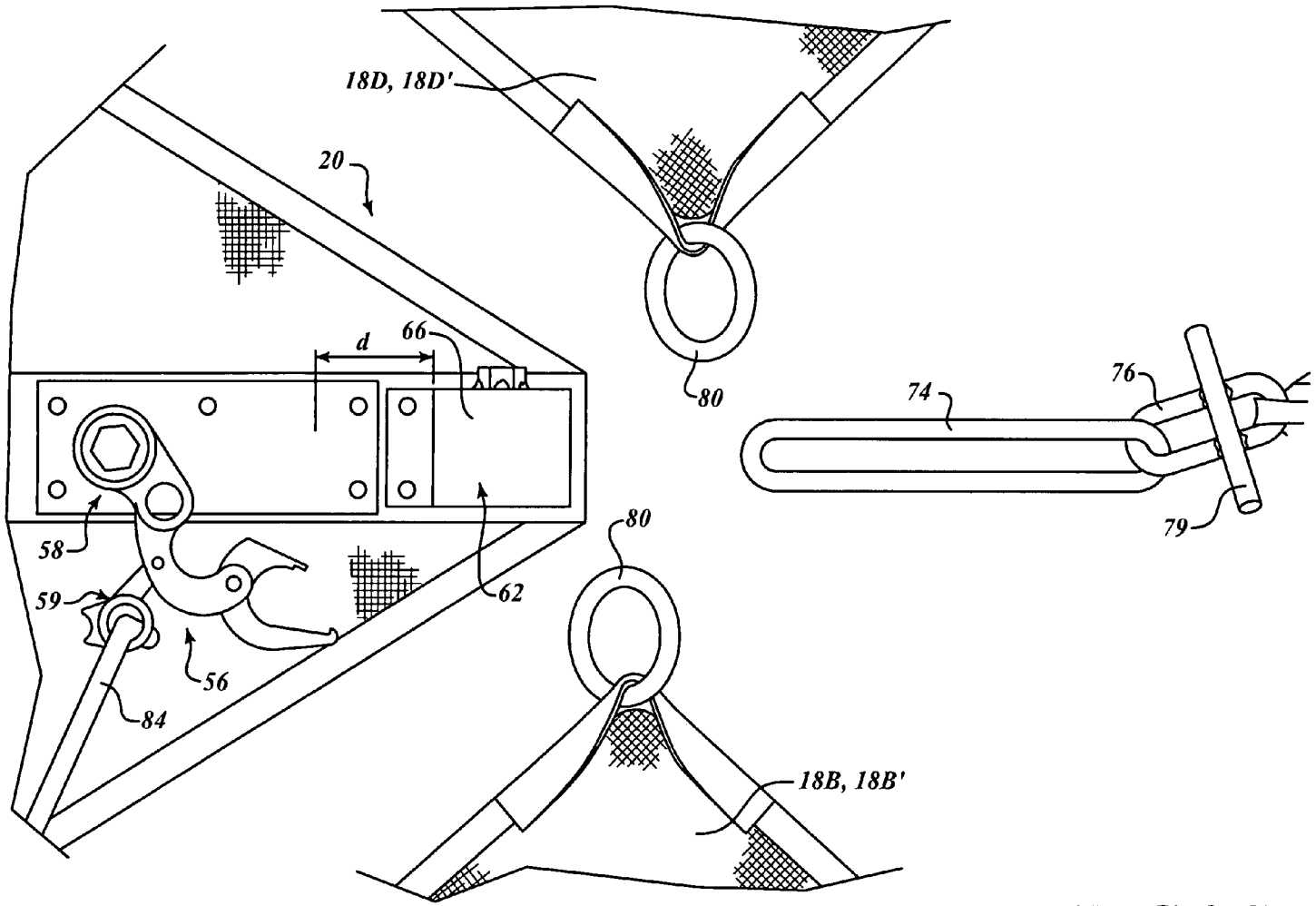

Referring now to FIGS. 9A-9C, components of the release mechanism 20 cooperate to permit content of the bottom-dumping flexible debris container 10 to exit via the bottom section 16 when the flexible bottom members 18 are released from releasable attachment to each other, such as at the block 130 (FIGS. 8J and 8K). A tag line 84 can be pulled to apply a pulling force on the force point 59, thereby launching the release hook 56. The release hook 56 sweeps across the opening path of travel d while opening from its closed position (in which the elongated link 74 is captive) to an open position. The rigid spacing platform 58 helps maintain a substantially constant relative spatial relationship along the opening path of travel d as the release hook 56 sweeps though its opening motion, thereby helping maintain the opening path of travel d substantially free from interference from buckling and the like. With the release hook 56 repositioned in its open position, the elongated link 74 can be released from its captive capture within the release hook 56. As such, force from gravitational downward urging of content 22 (not shown) of the bottom-dumping flexible debris container 10 biases apart the flexible bottom members 18, causing the elongated link 74 to move away from the release hook 56 through the frame 62.

Referring now to FIG. 9B, because the safety stop member 72 (not shown) has been removed from the frame body 66, due to gravitational downward urging of content 22 (not shown) of the bottom-dumping flexible debris container 10 the elongated link 74 can continue to separate from the release hook 56 and can exit the frame 62.

Figure 1B:
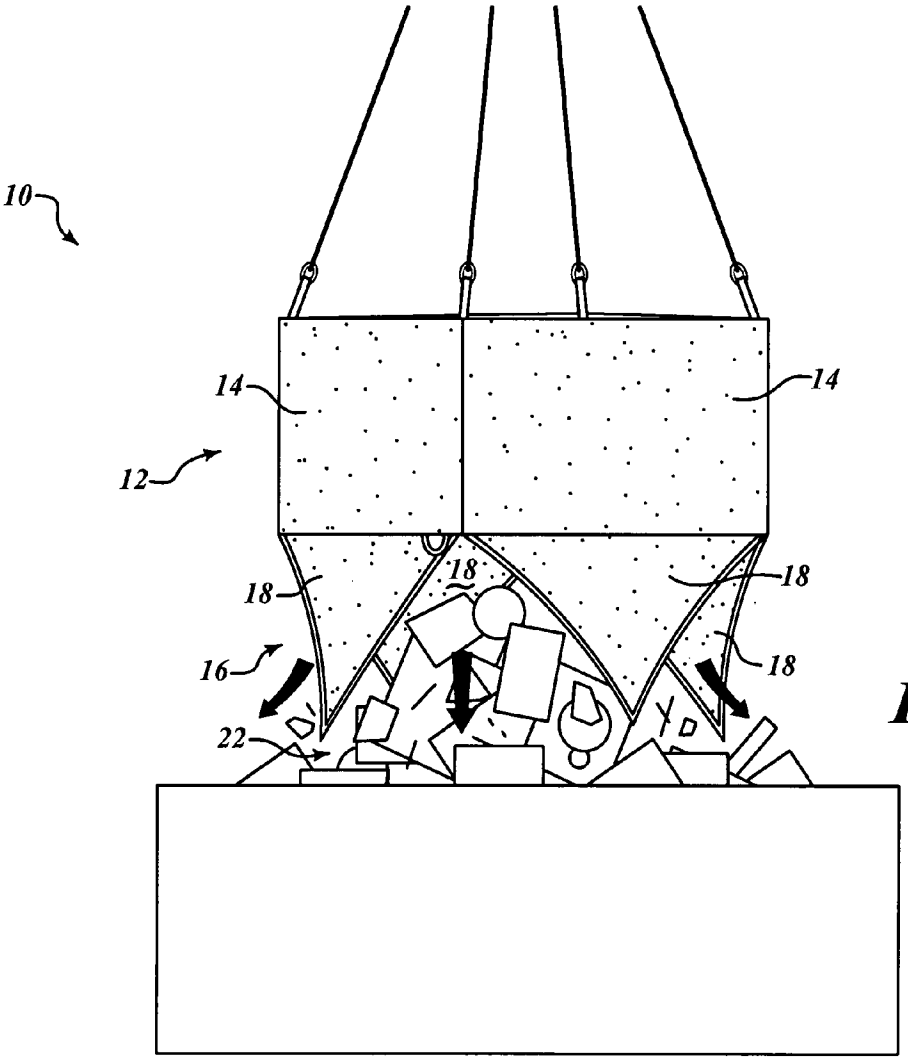
Figure 1C:
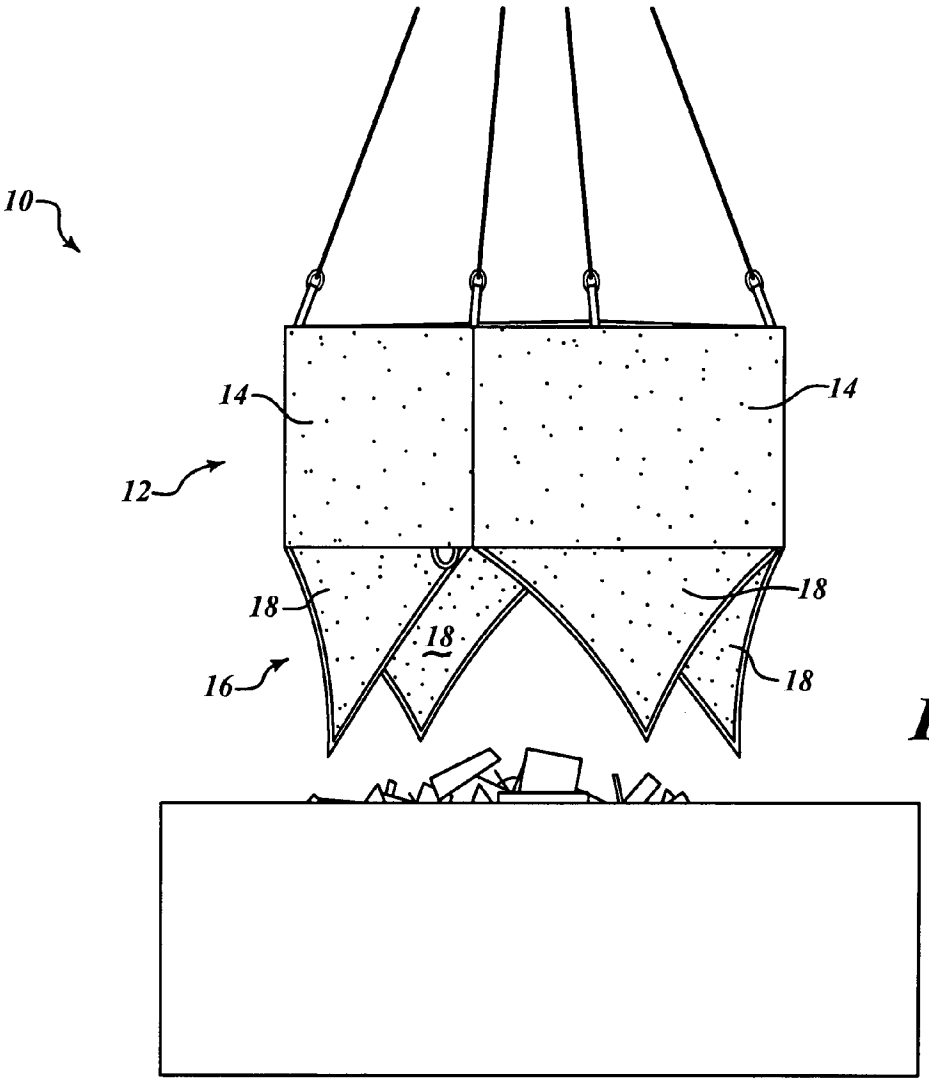

Referring now to FIG. 9C, the elongated link 74 has exited the frame 62. The flexible bottom members 18 continue to separate from each other and hingedly rotate downward due to gravitational urging and downward biasing from content 22 (not shown) of the bottom-dumping flexible debris container 10. Referring briefly back to FIGS. 1B and 1C, the content 22 has biased the flexible bottom members 18 sufficiently apart such that the content 22 is gravitationally urged downward and exits the bottom-dumping flexible debris container 10 through the opening in the bottom section 16 caused by separation from each other of the flexible bottom members 18.

Figure 10A:
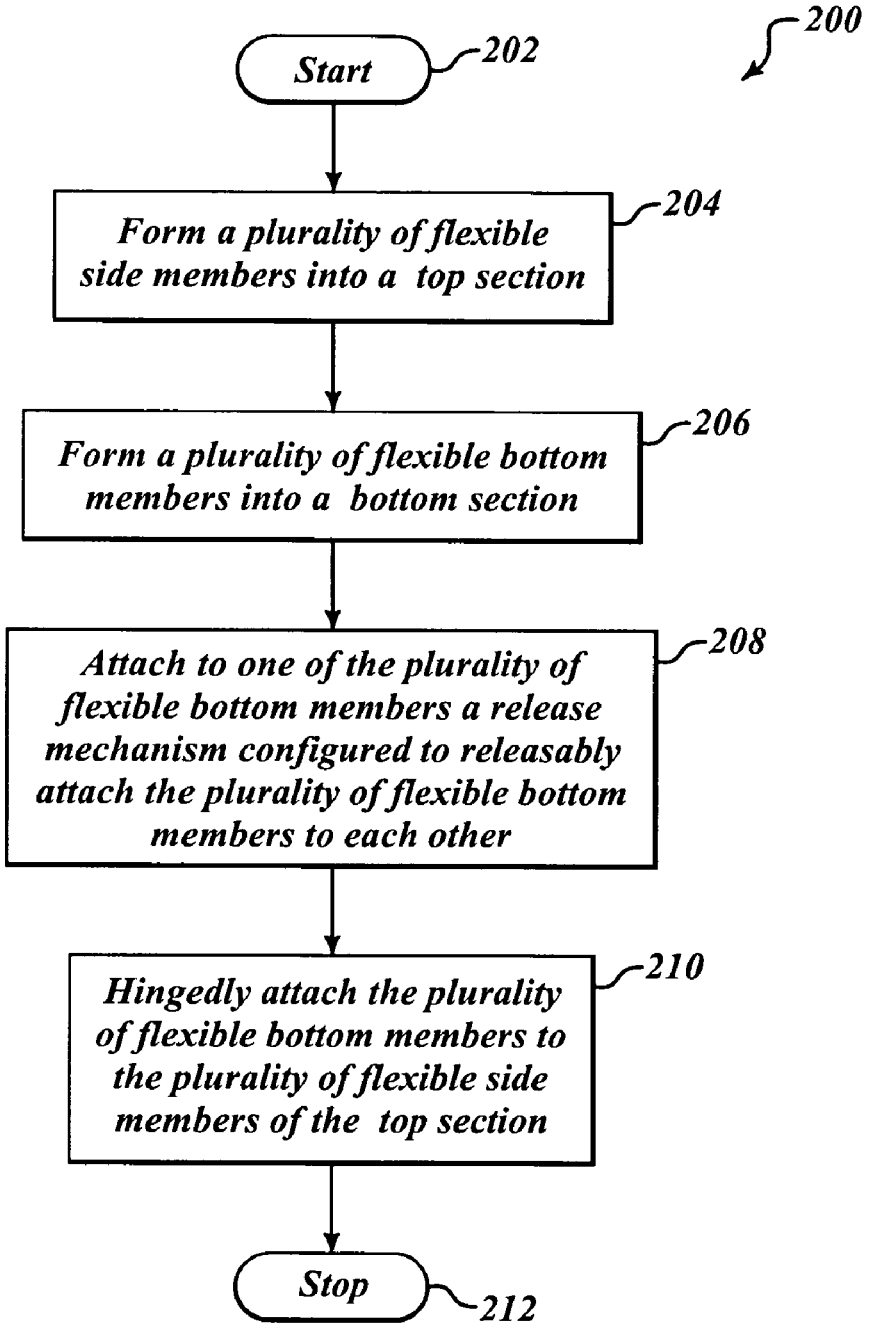
FIG. 10A is a flow chart of an illustrative method of manufacturing a bottom-dumping flexible debris container.

Non-limiting examples of manufacturing of the bottom dumping debris container 10 will now be explained. Referring now to FIG. 10A, an illustrative method 200 for manufacturing a bottom-dumping flexible container starts at a block 202. At a block 204 a plurality of flexible side members are formed into a top section. The plurality of flexible side members may be made from flexible materials as desired for a particular application. For example, in some embodiments mesh materials, such as vinyl coated polyester mesh material, may be used. However, it will be appreciated that any flexible material, such as without limitation fabric, polyester, plastic, or the like, may be used as desired for a particular application. At a block 206 a plurality of flexible bottom members are formed into a bottom section. The plurality of flexible bottom members may be made from flexible materials as desired for a particular application. For example, in some embodiments mesh materials, such as vinyl coated polyester mesh material, may be used. However, it will be appreciated that any flexible material, such as without limitation fabric, polyester, plastic, or the like, may be used as desired for a particular application. At a block 208 a release mechanism configured to releasably attach the plurality of flexible bottom members to each other is attached to one of the plurality of flexible bottom members. At a block 210 the plurality of flexible bottom members are hingedly attached to the plurality of flexible side members of the top section. The method 200 stops at a block 212.

It will be appreciated that blocks of the method 200 are shown in an order for illustration purposes only. For purposes of brevity, all possible combinations of orders for performance of the blocks of the method 200 are not shown. It will be appreciated that the blocks of the method 200 need not be performed in the order illustrated. In some embodiments, if desired some blocks of the method 200 may be performed in a sequential order that is different from the illustrated order. In some other embodiments, if desired some blocks of the method 200 may be performed simultaneously with performance of other blocks. Thus, no limitation is intended, and is not to be inferred, regarding ordering of blocks for the method 200.

Illustrative details regarding materials and manufacturing techniques have already been discussed above. These details are incorporated by reference into this discussion of the method 200. For sake of brevity, these details need not be repeated.

Figure 10B:
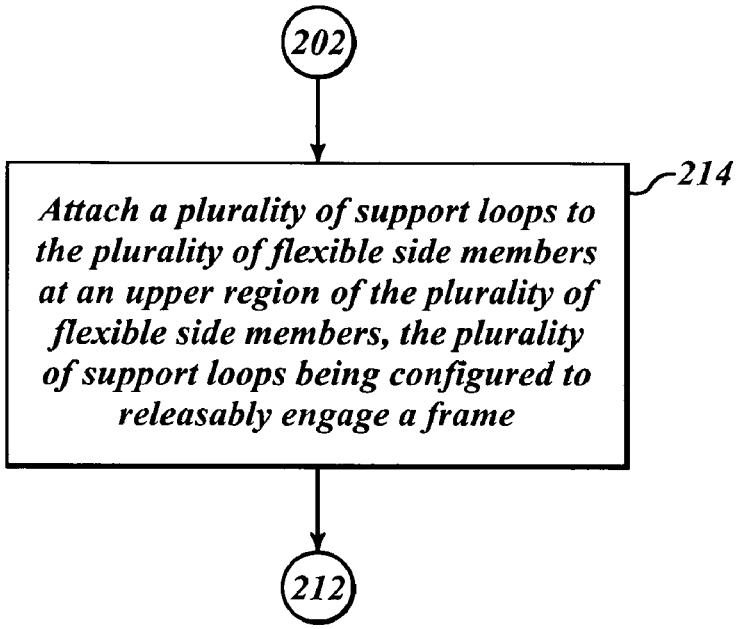
FIGS. 10B-10M are flow charts of details of the method of FIG. 10A.

Referring now to FIG. 10B, at a block 214 a plurality of support loops may be attached to the plurality of flexible side members at an upper region of the plurality of flexible side members, the plurality of support loops being configured to releasably engage a frame. For example, the frame may be configured to support the bottom-dumping flexible container on a substantially horizontal surface. As another example, the frame may maintain the shape of the bottom-dumping flexible container when the bottom-dumping flexible container is to be suspended aloft to abut an opening in a structure where debris can be loaded, such as scaffolding, windows, sliding doors, or the like.

Figure 10C:
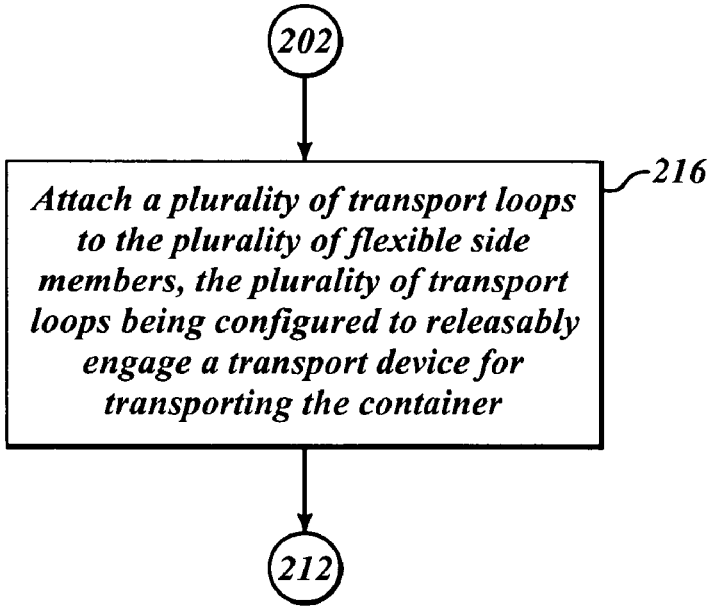

Referring now to FIG. 10C, at a block 216 a plurality of transport loops may be attached to the plurality of flexible side members, the plurality of transport loops being configured to releasably engage a transport device for transporting the container. The plurality of transport loops may be made from material such as nylon webbing or the like.

Figure 10D:
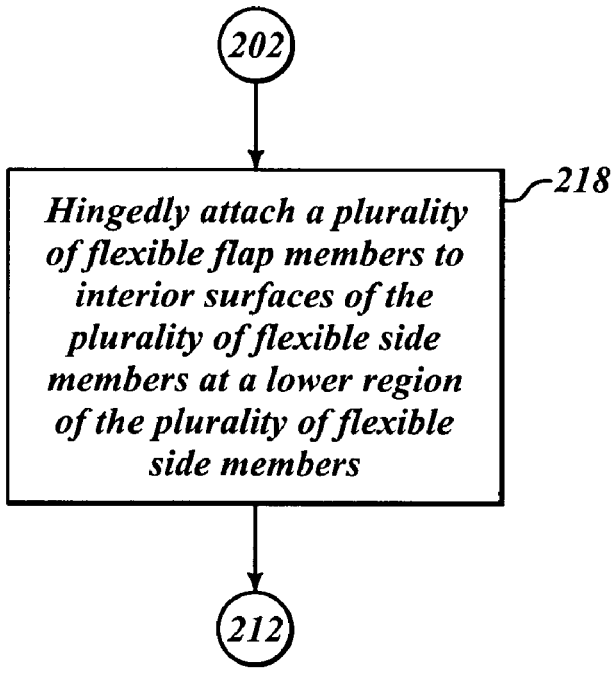

Referring now to FIG. 10D, at a block 218 a plurality of flexible flap members may be hingedly attached to interior surfaces of the plurality of flexible side members at a lower region of the plurality of flexible side members. The plurality of flexible flap members may be made from flexible material. For example, in some embodiments mesh materials, such as vinyl coated polyester mesh material, may be used. However, it will be appreciated that any flexible material, such as without limitation fabric, polyester, plastic, or the like, may be used as desired for a particular application.

Figure 10E:
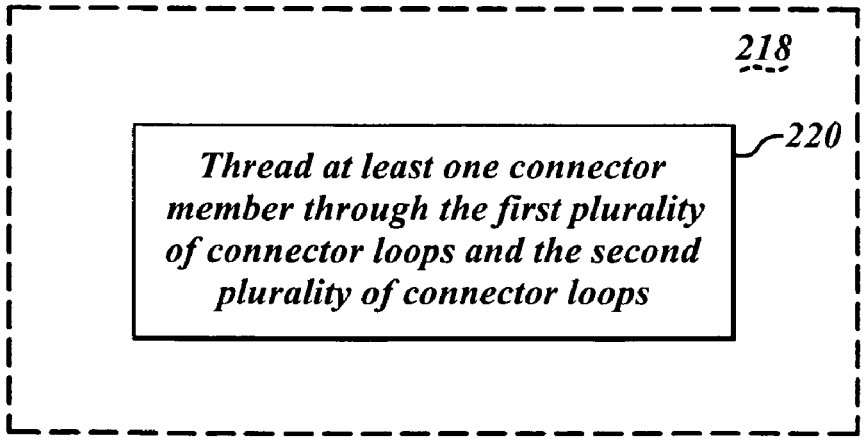

Referring now to FIG. 10E, in some embodiments the plurality of flexible side members can include a first plurality of connector loops and the plurality of flexible bottom members can include a second plurality of connector loops that alternate with the first plurality of connector loops such that connector loops of the first plurality of connector loops are adjacent connector loops of the second plurality of connector loops. In such an arrangement, hingedly attaching the plurality of flexible bottom members to the plurality of flexible side members of the top section at the block 218 can include threading at least one connector member through the first plurality of connector loops and the second plurality of connector loops at a block 220.

Figure 10F:
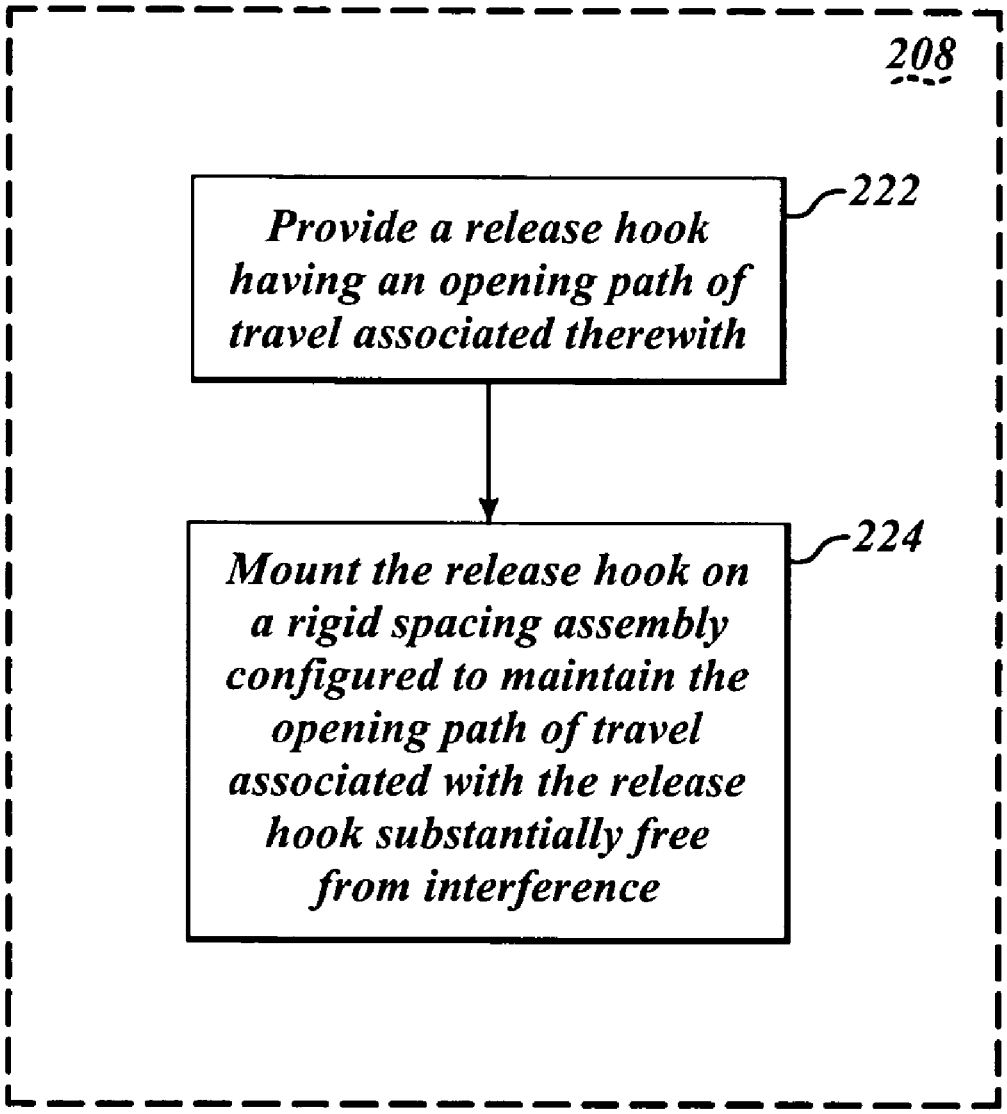

Referring now to FIG. 10F, attaching to one of the plurality of flexible bottom members a release mechanism configured to releasably attach the plurality of flexible bottom members to each other at the block 208 can providing a release hook having an opening path of travel associated therewith at a block 222. The block 208 can also include mounting the release hook on a rigid spacing assembly configured to maintain the opening path of travel associated with the release hook substantially free from interference at a block 224.

Figure 10G:
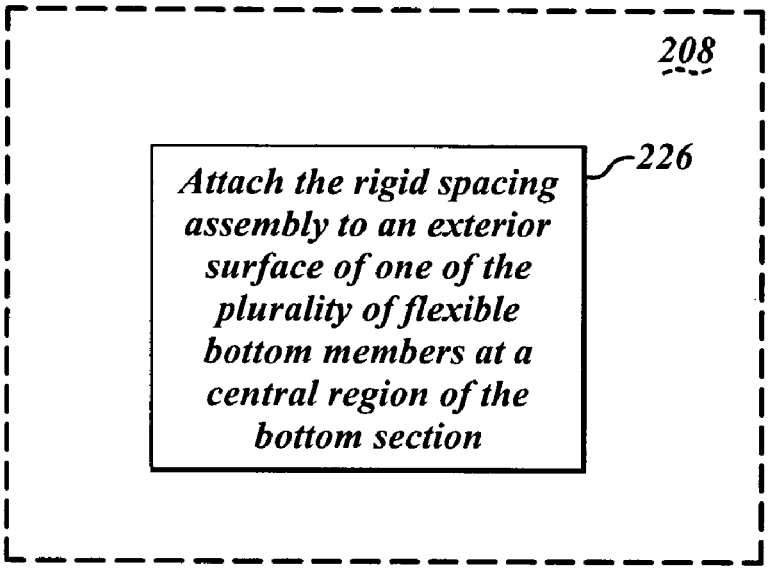

Referring now to FIG. 10G, attaching to one of the plurality of flexible bottom members a release mechanism configured to releasably attach the plurality of flexible bottom members to each other at the block 208 can also include attaching the rigid spacing assembly to an exterior surface of one of the plurality of flexible bottom members at a central region of the bottom section at a block 226.

Figure 10H:
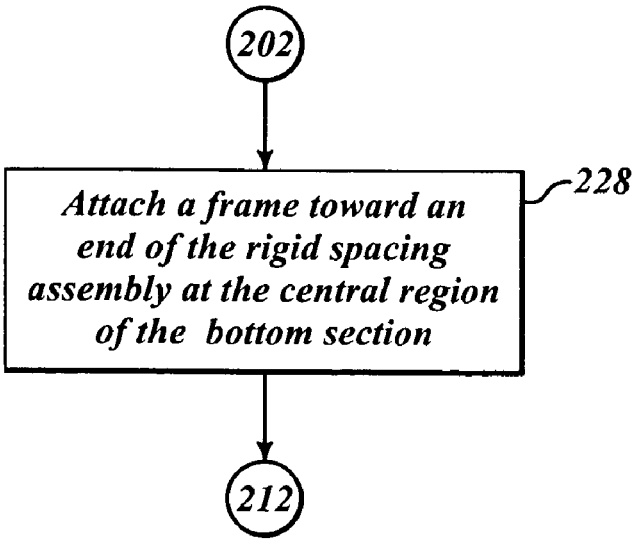

Referring now to FIG. 10H, at a block 228 a frame can be attached toward an end of the rigid spacing assembly at the central region of the bottom section.

Figure 10I:
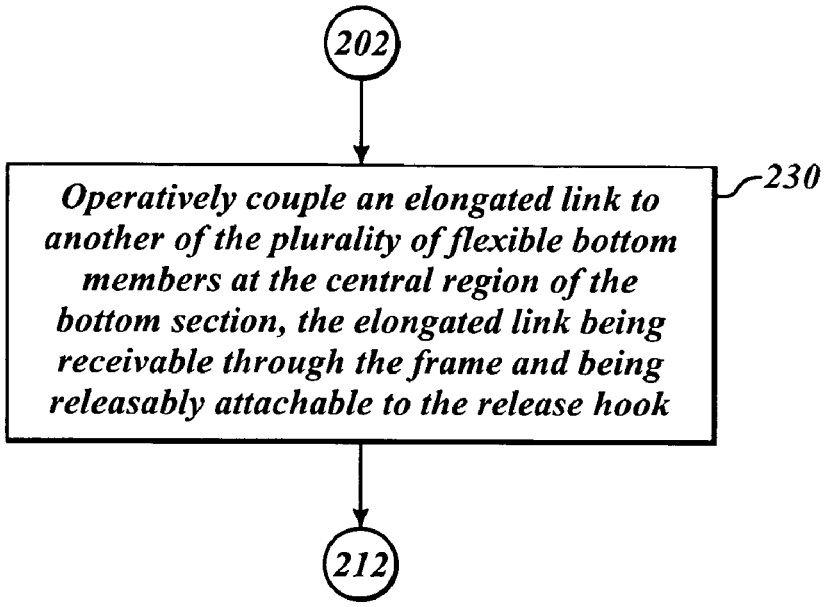

Referring now to FIG. 10I, at a block 230 an elongated link can be operatively coupled to another of the plurality of flexible bottom members at the central region of the bottom section, the elongated link being receivable through the frame and being releasably attachable to the release hook.

Figure 10J:
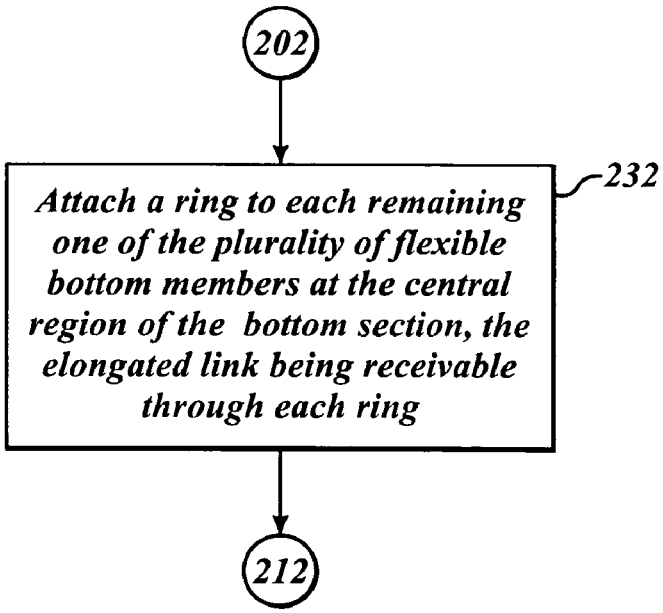

Referring now to FIG. 10J, at a block 232 a ring can be attached to each remaining one of the plurality of flexible bottom members at the central region of the bottom section, the elongated link being receivable through each ring.

Figure 10K:
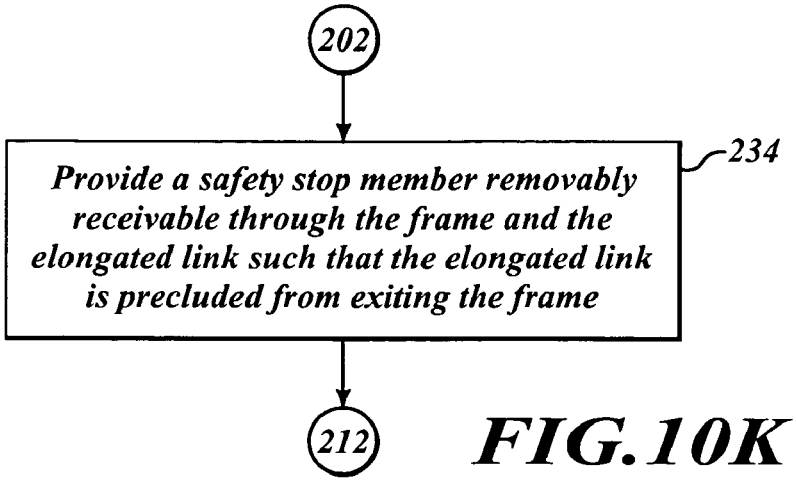

Referring now to FIG. 10K, at a block 234 a safety stop member can be provided that may be removably receivable through the frame and the elongated link such that the elongated link is precluded from exiting the frame.

Figure 10L:
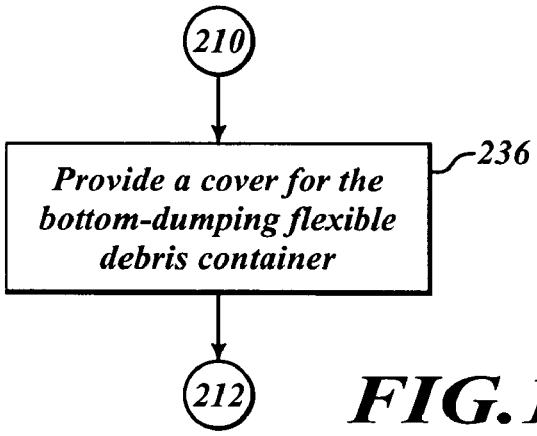

Referring now to FIG. 10L, at a block 236 a cover can be provided for the bottom-dumping flexible debris container.

Figure 10M:
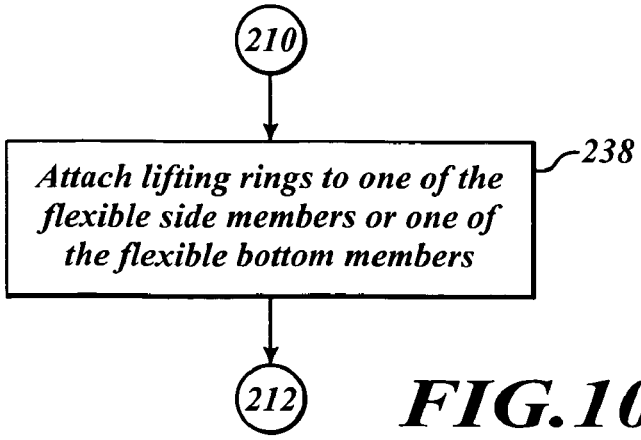

Referring now to FIG. 10M, at a block 238 lifting rings can be attached to one of the flexible side members or one of the flexible bottom members. The lifting rings can permit the bottom-dumping flexible debris container to be lifted and rotated such that content of the bottom-dumping flexible debris container can be dumped out a top of the bottom-dumping flexible debris container when dumping the content of the bottom-dumping flexible debris container out the bottom of the bottom-dumping flexible debris container is unavailable.

While a number of illustrative embodiments and aspects have been illustrated and discussed above, those of skill in the art will recognize certain modifications, permutations, additions, and sub-combinations thereof. It is therefore intended that the following appended claims and claims hereafter introduced are interpreted to include all such modifications, permutations, additions, and sub-combinations as are within their true spirit and scope.

What is claimed is:

1. A bottom-dumping flexible debris container comprising:

a top section including a plurality of flexible side members; and a bottom section including:

a plurality of flexible bottom members that are hingedly attached to the plurality of flexible side members of the top section; and a release mechanism configured to releasably attach the plurality of flexible bottom members to each other, the release mechanism including:

a release hook having an opening path of travel associated therewith;

a rigid spacing assembly configured to maintain the opening path of travel associated with the release hook substantially free from interference, the release hook being mounted on the rigid spacing assembly;

a frame attached toward an end of the rigid spacing assembly at the central region of the bottom section;

an elongated link operatively coupled to another of the plurality of flexible bottom members at the central region of the bottom section, the elongated link being receivable through the frame and being releasably attachable to the release hook; and a plurality of rings, with one or more of the plurality of rings each respectively attached to each remaining one of the plurality of flexible bottom members at the central region of the bottom section, the elongated link being receivable through the each of the plurality of rings; and, wherein the rigid spacing assembly is attached to an exterior surface of one of the plurality of flexible bottom members at a central region of the bottom section.

2. The container of claim 1, further comprising a plurality of support loops attached to the plurality of flexible side members at an upper region of the plurality of flexible side members, the plurality of support loops being configured to releasably engage a frame.

3. The container of claim 1, further comprising a plurality of transport loops attached to the plurality of flexible side members, the plurality of transport loops being configured to releasably engage a transport device for transporting the container.

4. The container of claim 1, wherein the top section further includes a plurality of flexible flap members hingedly attached to interior surfaces of the plurality of flexible side members at a lower region of the plurality of flexible side members.

5. The container of claim 1, wherein:

the plurality of flexible side members includes a first plurality of connector loops;

the plurality of flexible bottom members includes a second plurality of connector loops that alternate with the first plurality of connector loops such that connector loops of the first plurality of connector loops are adjacent connector loops of the second plurality of connector loops; and at least one connector member threaded through the first plurality of connector loops and the second plurality of connector loops.

6. The container of claim 1, wherein the release mechanism includes:

a release hook having an opening path of travel associated therewith; and a rigid spacing assembly configured to maintain the opening path of travel associated with the release hook substantially free from interference, the release hook being mounted on the rigid spacing assembly.

7. The container of claim 1, wherein the release mechanism further includes a safety stop member removably receivable through the frame and the elongated link such that the elongated link is precluded from exiting the frame.

8. The container of claim 1, further comprising:

a cover configured to cover an opening of the top section.

9. The container of claim 1, further comprising:

at least one lifting ring attached to a member chosen from a one of the flexible side members and one of the flexible bottom members.

10. A method of using a bottom-dumping flexible container, the method comprising:

attaching to one of a plurality of flexible bottom members a release mechanism configured to releasably attach the plurality of flexible bottom members to each other, the release mechanism including:

a release hook having an opening path of travel associated therewith;

a rigid spacing assembly configured to maintain the opening path of travel associated with the release hook substantially free from interference, the release hook being mounted on the rigid spacing assembly;

a frame attached toward an end of the rigid spacing assembly at the central region of the bottom section;

an elongated link operatively coupled to another of the plurality of flexible bottom members at the central region of the bottom section, the elongated link being receivable through the frame and being releasably attachable to the release hook; and a plurality of rings, with one or more of the plurality of rings each respectively attached to each remaining one of the plurality of flexible bottom members at the central region of the bottom section, the elongated link being receivable through the each of the plurality of rings; and releasably attaching to each other the plurality of flexible bottom members of a bottom section of a bottom-dumping flexible container toward a central region of the bottom section; and supporting a top section of the bottom-dumping flexible container, the top section having a plurality of flexible side members, the top section being hingedly attached to the plurality of flexible bottom members.

11. The method of claim 10, wherein releasably attaching to each other the plurality of flexible bottom members of a bottom section of a bottom-dumping flexible container toward a central region of the bottom section includes:

receiving the elongated link attached to one of the plurality of flexible bottom members at the central region of the bottom section through the rings attached to selected ones of the plurality of flexible bottom members at the central region of the bottom section;

inserting the elongated link through the frame attached toward an end of a rigid spacing assembly at the central region of the bottom section, the rigid spacing assembly being attached to an exterior surface of one of the plurality of flexible bottom members; and releasably attaching the elongated link to the release hook that is mounted on the rigid spacing assembly.

12. The method of claim 11, further comprising releasing the plurality of flexible bottom members from releasable attachment to each other such that content of the bottom-dumping flexible container is gravitationally urged from the bottom-dumping flexible container.

13. The method of claim 12, wherein releasing the plurality of flexible bottom members from releasable attachment to each other includes:

opening the release hook such that the elongated link is released from attachment to the release hook.

14. The method of claim 10, wherein releasably attaching to each other the plurality of flexible bottom members of a bottom section of a bottom-dumping flexible container toward a central region of the bottom section includes:

removably receiving a safety stop member through the frame and the elongated link such that the elongated link is precluded from exiting the frame.

15. The method of claim 14, further comprising removing the safety stop member from the frame and the elongated link such that the elongated link can exit the frame.

16. The method of claim 10, further comprising overlapping a plurality of flexible flap members hingedly attached to interior surfaces of the plurality of flexible side members at a lower region of the plurality of flexible side members such that the plurality of flexible flap members overlie the plurality of flexible bottom members.

17. The method of claim 10, wherein supporting a top section of the bottom-dumping flexible container includes removably attaching the top section of the bottom-dumping flexible container to at least one stand that is configured to support the container on a substantially horizontal surface.

18. The method of claim 10, wherein supporting a top section of the bottom-dumping flexible container includes removably attaching the top section of the bottom-dumping flexible container to a frame configured to maintain a shape of the bottom-dumping flexible container.

19. The method of claim 10, further comprising releasably attaching to a transport device a plurality of transport loops that are attached to the plurality of flexible side members.

20. The method of claim 10, further comprising transporting the bottom-dumping flexible container to a receptacle such that content of the bottom-dumping flexible container is receivable from the bottom section into the receptacle.

21. The method of claim 10, further comprising:

covering the bottom-dumping flexible container.

22. The method of claim 10, further comprising:

dumping content of the bottom-dumping flexible debris container out a top of the bottom-dumping flexible debris container.

23. A method of manufacturing a bottom-dumping flexible container, the method comprising:

forming a plurality of flexible side members into a top section;

forming a plurality of flexible bottom members into a bottom section;

attaching to one of the plurality of flexible bottom members a release mechanism configured to releasably attach the plurality of flexible bottom members to each other, the release mechanism including:

a release hook having an opening path of travel associated therewith;

a rigid spacing assembly configured to maintain the opening path of travel associated with the release hook substantially free from interference, the release hook being mounted on the rigid spacing assembly;

a frame attached toward an end of the rigid spacing assembly at the central region of the bottom section;

an elongated link operatively coupled to another of the plurality of flexible bottom members at the central region of the bottom section, the elongated link being receivable through the frame and being releasably attachable to the release hook; and a plurality of rings, with one or more of the plurality of rings each respectively attached to each remaining one of the plurality of flexible bottom members at the central region of the bottom section, the elongated link being receivable through the each of the plurality of rings; and hingedly attaching the plurality of flexible bottom members to the plurality of flexible side members of the top section.

24. The method of claim 23, wherein the plurality of flexible side members are made from flexible material chosen from mesh material, vinyl coated polyester mesh material, fabric, polyester, and plastic.

25. The method of claim 23, wherein the plurality of flexible bottom members are made from flexible material chosen from mesh material, vinyl coated polyester mesh material, fabric, polyester, and plastic.

26. The method of claim 23, further comprising attaching a plurality of support loops to the plurality of flexible side members at an upper region of the plurality of flexible side members, the plurality of support loops being configured to releasably engage a frame.

27. The method of claim 23, further comprising attaching a plurality of transport loops to the plurality of flexible side members, the plurality of transport loops being configured to releasably engage a transport device for transporting the container.

28. The method of claim 27, wherein the plurality of transport loops are made from material chosen from nylon webbing.

29. The method of claim 23, further comprising hingedly attaching a plurality of flexible flap members to interior surfaces of the plurality of flexible side members at a lower region of the plurality of flexible side members.

30. The method of claim 29, wherein the plurality of flexible flap members are made from flexible material chosen from mesh material, vinyl coated polyester mesh material, fabric, polyester, and plastic.

31. The method of claim 23, wherein:

the plurality of flexible side members includes a first plurality of connector loops;

the plurality of flexible bottom members includes a second plurality of connector loops that alternate with the first plurality of connector loops such that connector loops of the first plurality of connector loops are adjacent connector loops of the second plurality of connector loops; and wherein hingedly attaching the plurality of flexible bottom members to the plurality of flexible side members of the top section includes threading at least one connector member through the first plurality of connector loops and the second plurality of connector loops.

32. The method of claim 23, wherein the attaching to one of the plurality of flexible bottom members the release mechanism configured to releasably attach the plurality of flexible bottom members to each other includes:

providing the release hook having an opening path of travel associated therewith; and mounting the release hook on the rigid spacing assembly configured to maintain the opening path of travel associated with the release hook substantially free from interference.

33. The method of claim 32, wherein the attaching to one of the plurality of flexible bottom members the release mechanism configured to releasably attach the plurality of flexible bottom members to each other further includes:

attaching the rigid spacing assembly to an exterior surface of one of the plurality of flexible bottom members at a central region of the bottom section.

34. The method of claim 33, further comprising attaching a frame toward an end of the rigid spacing assembly at the central region of the bottom section.

35. The method of claim 34, further comprising operatively coupling the elongated link to another of the plurality of flexible bottom members at the central region of the bottom section, the elongated link being receivable through the frame and being releasably attachable to the release hook.

36. The method of claim 35, further comprising attaching the plurality of rings respectively to each remaining one of the plurality of flexible bottom members at the central region of the bottom section, the elongated link being receivable through each of the plurality of rings.

37. The method of claim 36, further comprising providing a safety stop member removably receivable through the frame and the elongated link such that the elongated link is precluded from exiting the frame.

38. The method of claim 23, further comprising:

providing a cover configured for the bottom-dumping flexible container.

39. The method of claim 23, further comprising:

attaching lifting rings to a member chosen from one of the flexible side members and one of the flexible bottom members.

* * * * *